US006790585B2

(12) United States Patent
Roussilhe et al.

(10) Patent No.: US 6,790,585 B2
(45) Date of Patent: Sep. 14, 2004

(54) METHOD FOR DEVELOPING A HIGH CONTRAST PHOTOGRAPHIC MATERIAL CONTAINING A POLYHYDRAZIDE NUCLEATING AGENT

(75) Inventors: Jacques Roussilhe, Virey le Grand (FR); Siu C. Tsoi, Watford (GB); John D. Goddard, Pinner (GB); Llewellyn J. Leyshon, Watford (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/465,491

(22) Filed: Jun. 19, 2003

(65) Prior Publication Data

US 2004/0023149 A1 Feb. 5, 2004

(30) Foreign Application Priority Data

Jun. 19, 2002 (FR) ..... 02 07603

(51) Int. Cl.[7] ..... G03C 5/29; G03C 5/315

(52) U.S. Cl. ..... 430/265; 430/264; 430/267; 430/436; 430/440; 430/441

(58) Field of Search ..... 430/265, 264, 430/267, 436, 440, 441

(56) References Cited

U.S. PATENT DOCUMENTS 5,130,226 A * 7/1992 Sampei et al. ..... 430/264
6,479,199 B2 * 11/2002 Fukawa ..... 430/30
6,713,226 B2 * 3/2004 Goddard et al. ..... 430/264

* cited by examiner

*Primary Examiner*—Hoa Van Le
(74) *Attorney, Agent, or Firm*—J. Jeffrey Hawley

(57) ABSTRACT

The present invention relates to a method for developing an exposed high contrast photographic silver halide material, said photographic material comprising a support bearing at least one silver halide emulsion layer, containing at least one hydrazide nucleating agent.

According to the invention, the nucleating agent has the formula (I)

and the photographic material is developed in a hydroquinone-free developer, comprising a main developing agent of the ascorbic acid or ascorbic acid salt type, and as auxiliary developing agent a mixture of 3-pyrazolidones of which at least one has the formula (II):

(II)

wherein at least one of the radicals $R^3$ to $R^9$ contains a solubilizing group.

This combination enables photographic materials with ultra-high contrast to be obtained.

19 Claims, No Drawings

METHOD FOR DEVELOPING A HIGH CONTRAST PHOTOGRAPHIC MATERIAL CONTAINING A POLYHYDRAZIDE NUCLEATING AGENT

CROSS REFERENCE TO RELATED APPLICATION

This application is cross-related to British patent application No. 0214122.4, filed Jun. 19, 2002.

FIELD OF THE INVENTION

The present invention relates to a method for developing an exposed high contrast photographic silver halide material, said photographic material comprising a support bearing at least one silver halide emulsion layer, containing at least one hydrazide nucleating agent in said emulsion layer and/or in a hydrophilic colloid layer.

BACKGROUND OF THE INVENTION

In the field of graphic arts, ultrahigh contrast photographic materials are required for achieving satisfactory halftone dot reproduction of a continuous tone or reproduction of a line image in the process of making a lithographic printing plate.

For many years, these ultrahigh contrast photographic images were obtained by developing a "lith" emulsion (usually high in silver chloride content) in a hydroquinone, low sulphite, "lith" developer by the process known as infectious development.

However, such low sulphite developers are inherently unstable and are particularly inappropriate for machine processing.

More recently, an imaging formation system providing ultrahigh contrast, where the gamma (contrast) exceeds 10 has been provided conventionally in a material wherein silver halides bearing a surface latent image are developed in the presence of a hydrazine (also known as a nucleating agent), specifically an acylhydrazine, that can be incorporated into the photographic material or into the developer. The pH of the developer solution is usually in the range 10.0 to 12.3, about 11.5, and the developer includes conventional amounts of sulphite, hydroquinone and possibly Metol® or a pyrazolidone.

While such a process is better than the low sulphite "lith" process, the developer still has a high pH requirement for it to function correctly. Such a developer solution is not as stable as is desirable. Additionally, high pH solutions are environmentally undesirable because of the care needed in handling and disposing of the effluent.

Unfortunately, light sensitive materials whose contrast is enhanced by the presence of a hydrazine nucleating agent show large variations in their photographic properties as, for example, the developer is exhausted or as the developer pH value varies in time, and in particular, reduces. The pH of the developer can vary for a number of reasons: for example, exhaustion and absorption of carbon dioxide cause the pH to drop whilst air oxidation causes the pH to rise, as can concentration through evaporation.

Also during development of silver halide materials, particularly those which use chlorobromide emulsions, there is a release of bromide locally into area of the development as a consequence of the development process to convert silver halide to elemental silver. Both of these effects can influence the development rate of the film give rise to process unevenness or variability during the processing run.

There is an overall effect which shows up as a change to the developer component levels in solution, but there is also a local effect which occurs within the developing layer and is exposure dependent. These effects can also depend on the formulation of the developer used and overcoming these problems can increase tolerance to a wider range of developer formulations.

It is also known that a developer solution having a pH below 11 can be employed by using certain hydrazides active at this pH. Hydrazides proposed for such use are described, for example, in U.S. Pat. Nos. 4,278,748; 4,031,127; 4,030,925; 4,323,643; 4,988,604 and 4,994,365 and in European Patent Application EP-A-0 333 435. A nucleating agent containing both a hydrazide moiety and a nicotinamide moiety is disclosed in U.S. Pat. No. 5,288,590. However the use of such a nucleating agent does not entirely remove sensitivity to both bromides and pH.

A nucleating agent that comprises a dimeric molecule comprising two monomers linked by a linking group, each monomer of which (a) may be the same or different and (b) comprises a hydrazide and a nicotinamide moiety, has been disclosed in U.S. Pat. No. 6,228,566. A nucleating agent comprising (a) two nicotinamide moieties, that may be the same or different, that are linked by a linking group, and (b) a hydrazide moiety linked to only one of those nicotinamide moieties, either alone or together with the nucleating agent comprising the dimeric molecule, has been described in U.S. Pat. No. 6,245,480. A nucleating agent as described in either of these two U.S. Patents in combination with a "conventional" aryl sulfonamido aryl hydrazide is described in European Patent Application EP-A-1 229 383. U.S. Pat. Nos. 4,988,604 and 4,994,365 describe aryl sulfonamidophenyl hydrazide nucleating agents which are capable of high contrast development.

Developer solutions with pHs below 11 can also be used by the introduction of a contrast-promoting agent (commonly called a booster) to give adequate activity. The booster can be incorporated into the photographic layer or may be dissolved in the developer solution. The booster may be, for example, one of the boosters as described in U.S. Pat. No. 5,316,889 or an amine booster as described in U.S. Pat. Nos. 4,269,929; 4,668,605, 4,740,452 or in European Patent Application EP-A-0 364 166. Compounds bearing different functionalities, for example phosphonium and pyridinium, have also been shown to be active, as described in U.S. Pat. No. 5,744,279.

In the non-imaged areas on the processed film unwanted small dots can appear and this is called "pepper fog". This is due to unintentionally fogged grains developing and being amplified by the nucleation process and being rendered visible. Nucleating agents which are unstable or more active and diffuse more rapidly can result in more and larger pepper fog spots. In high contrast materials therefore a balance needs to be achieved between vigorous development and pepper fog.

Another factor to be considered is the chemical spread (or image spread) which is a measure of the increase in size of developed dots or lines produced by nucleation of the edge of the image area causing development of the image boundary beyond the original exposed edge. This spread is small but measurable and can reduce the resolution of very fine lines.

A further consideration is the efficiency of synthesis of the nucleating agents and the robustness of the chemical processes used for their synthesis. It is desirable that the nucleating agents and their intermediates are formed rapidly and efficiently at all stages of the synthesis since heating and/or prolonged reaction times can have an adverse effect on their purity.

Furthermore, while it may be desirable from the costs point of view to prepare a mixture of nucleating agents (as in U.S. Pat. No. 6,245,480) without the need for purification or separation of the nucleating agents, for regulatory purposes it is mandatory to provide a mixture wherein the proportions of components are within defined limits. When a chemical reaction produces a mixture of nucleating agents and impurities, it is not always possible to ensure that the various components will be within the defined limits and thus the process, although cost effective when successful, is less robust and consistent than desired.

SUMMARY OF THE INVENTION

The present invention is a method for developing an exposed high contrast photographic material, said photographic material comprising a support bearing at least one silver halide emulsion layer, containing at least one hydrazide nucleating agent, characterized in that a) said nucleating agent has the formula (I):

(I)

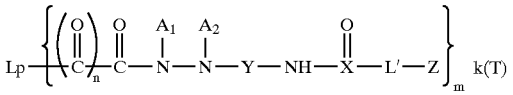

wherein each $A_1$ and each $A_2$ is independently selected from the class consisting of a hydrogen atom, or a substituted or unsubstituted acyl group, and an alkyl- or aryl-sulfonyl group;

each Y is independently selected from a substituted or unsubstituted aryl or heterocyclic ring or ring system;

each X is independently selected from S═O, C, C—NH and C—O;

each L' is independently selected from a substituted or unsubstituted alkylene group; or a substituted or unsubstituted aryl or heterocyclic ring or ring system linked to Z via a substituted or unsubstituted alkylene group either directly or via a group selected from $NR_1CO$—, $NR_1CONR_2$—, $OCONR_1$— or $NR_1COO$—, wherein $R_1$ and $R_2$ are independently selected from a hydrogen atom or a substituted or unsubstituted alkyl group;

each Z is independently selected from an unsubstituted or substituted group, ring or ring system attached via a heteroatom selected from sulfur, nitrogen, oxygen or phosphorus;

each L is independently a divalent, trivalent or tetravalent linking group;

p and each n are independently 0 or 1 k is an integer from 0 to 8;

and m is an integer from 2 to 4 provided that when p is 0, n is 0 and m is 2;

when p is 1, n is 0 or 1 and m is 2, 3 or 4; and

T is a counterion or a salt forming acid, and characterized in that b) said photographic material is developed in a hydroquinone-free developer, comprising a main developing agent of the ascorbic acid or ascorbic acid salt type, and as auxiliary developing agent a mixture of 3-pyrazolidones of which at least one has the formula (II), (II)

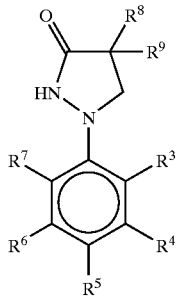

wherein $R^8$ and $R^9$ each independently represent hydrogen, a substituted or unsubstituted alkyl group, or a group represented by the formula:

$$(CH_2)_x—(L_1)_{n1}—A—(Sol)$$

wherein x is between 0 and 5 and $n_1$ is 0 or 1, $L_1$ represents a divalent group selected from

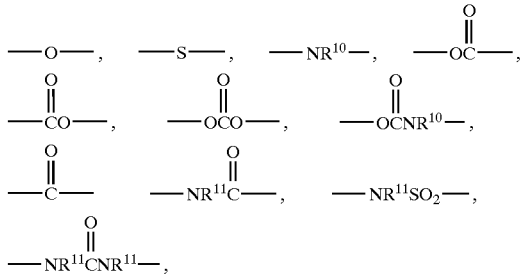

wherein $R^{10}$=$R^{11}$ or A—(Sol), $R^{11}$=H, alkyl or aryl;

A represents a divalent group selected from

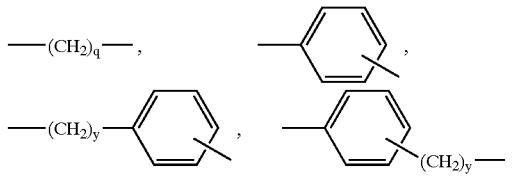

wherein q is between 0 and 5, and y is between 1 and 3;

(Sol) is a solubilizing group selected from:

$CO_2H$, $SO_3H$ or a salt, $SO_3K$, $NHSO_2R^{12}$, $SO_2NH_2$, $SO_2NHR^{12}$, polyhydroxyalkyl,

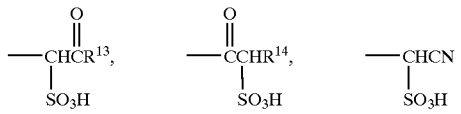

wherein $R^{12}$ is alkyl or aryl, $R^{13}$ is OH, alkyl or aryl and $R^{14}$ is hydrogen, alkyl or aryl;

$R^3$ to $R^7$ in formula (II) each independently represent hydrogen, an alkyl group, a substituted or unsubstituted alkoxy group, a substituted or unsubstituted aryloxy group, or a group represented by the formula:

$$(X_1)_z—(CH_2)_x—(L_1)_{n1}—A—(Sol)$$

wherein z =0 or 1;

$X_1$ represents a divalent group selected from

—O—, —S—, —$NR^{10}$— x, $L_1$, $n_1$, A, (Sol) and $R^{10}$ are as defined above, with the further proviso that at least one of the radicals $R^3$ to $R^9$ must contain a (Sol) group.

The present invention provides a method for developing an exposed high contrast photographic material in a developer that uses a) a nucleating agent, incorporated into the photographic material, that gives ultrahigh contrast whilst at the same time showing less sensitivity to variations in the development conditions, such as pH or development time, and that may be synthesized rapidly, efficiently, in a cost effective and robust manner and having consistent purity and constitution, and b) a hydroquinone-free developer with a pH below 11, that results in a ultrahigh contrast photographic material without necessarily using a contrast-promoting agent.

The present invention resides in the use of a photographic material comprising a nucleating agent having 2 to 4 hydrazide moieties linked directly to one another or to one another by a linking group, and of a developer comprising a ternary mixture of developers such as described above for the development of this photographic material. Unexpectedly, this combination allows to obtain good nucleation and less sensitivity to the variations in development conditions than do conventional nucleating agents, leading to significant improvements in processing robustness, and ultrahigh contrast, even if the developer has a pH below 11 and without the need to add a contrast-promoting agent. In addition, the syntheses of the nucleating agents used in the present invention are more consistent, efficient and robust than those of dimeric nucleators and mixtures of dimeric nucleating agents previously reported in the literature. An additional advantage of the present invention is the use of co-developer having improved solubility, enabling the formulation of stable liquid concentrates (in particular in relation to low temperatures) and in one part, the formulation of powder developers that dissolve easily without excessive heat. This provides for the reduction of the number of parts in kits, the volume of the packs and results in greater ease of use.

DETAILED DESCRIPTION OF THE INVENTION

In the method according to the present invention, the exposed high contrast photographic material to be developed contains in an emulsion layer and/or in a hydrophilic colloid layer a nucleating agent having the general structure (I) as defined above in the Summary of the Invention.

In the formula (I), each $A_1$ and each $A_2$ is independently a hydrogen atom or a substituted or unsubstituted acyl group, such as, for example a trifluoroacetyl group, or a substituted or unsubstituted alkyl- or aryl-sulfonyl group, but preferably each $A_1$ and each $A_2$ is hydrogen atom.

Each Y is independently a substituted or unsubstituted aryl ring or ring system, such as, for example, a phenyl or naphthyl group, or a substituted or unsubstituted heterocyclic ring or ring system, such as, for example, a pyridine, pyrrole, furan, thiophene, thiazole or imidazole group, or a benzo derivative of any of these. However each Y is preferably a phenyl group, optionally substituted, for example, with 1 to 4 substituents selected from halogen, hydroxy, cyano and a substituted or unsubstituted alkyl, aryl, heterocyclyl, alkoxy, acyloxy, aryloxy, carbonamido, sulfonamido, ureido, thioureido, semicarbazido, thiosemicarbazido, urethane, quaternary ammonium, alkyl- or aryl-thio, alkyl- or aryl-sulfonyl, alkyl- or aryl-sulfinyl, carboxyl, alkoxy- or aryloxy-carbonyl, carbamoyl, sulfamoyl, phosphonamido, diacylamino, imido or acylurea group, a group containing a selenium or tellurium atom, and a group having a tertiary sulfonium structure.

More preferably, each Y is an unsubstituted phenyl group or a phenyl group substituted, for example, with an alkylthio or alkylsulfonamido group or in particular with an alkyl or alkoxy group, especially in a position ortho to the hydrazino group, or for example, with a trifluoromethyl group, especially in a position meta to the hydrazino group.

Each X independently represents S═O, C, C—NH and C—O but is preferably S═O or C. When X is S═O, C—NH or C—O, L' can comprise a substituted or unsubstituted alkylene group, especially a methylene group, but it is preferred that L' comprises a substituted or unsubstituted aryl ring, preferably a phenyl ring, linked to Z via a substituted or unsubstituted alkylene group, especially a methylene group, either directly or preferably via a $NR_1CO$— group, wherein $R_1$ is a hydrogen atom or a substituted or unsubstituted alkyl group, more particularly via a NHCO— group. The aryl ring of L' may suitably be substituted, for example, with one or more alkyl, carboxyl groups or halogen atoms, and in particular with one or more trifluoromethyl or alkyl groups. When X is C, it is preferred that L' comprises a substituted or unsubstituted alkylene group, preferably a methylene group.

Each Z is independently an unsubstituted or substituted group, ring or ring system, attached via a heteroatom selected from sulfur, nitrogen, oxygen or phosphorus and may be or form with the heteroatom, for example, an alkyl group or a heterocyclic ring, such as a pyridyl or imidazolyl ring, or an alkyl-, aryl- or heterocyclyl-thio group, such as for example, a mercaptopropionic acid, a mercaptopyridyl or mercaptotetrazole group or an amino, quartenary ammonium, phosphine, phosphonium, sulfonium, thioureido, isothiouronium or thiocarbamate group. Suitable substituents include, for example, alkyl, aryl, alkylamino, dialkylamino, cyclohexenyl, piperidinyl, pyridyl, carbonamido, alkylcarbonamido or dialkylcarbonamido group, any of which may be further substituted, for example, with one or more alkyl, hydroxy, pyridylcarbonamido or alkynyl groups.

More preferably Z is attached via a sulfur or nitrogen atom and is most preferably an unsubstituted pyridyl group or a pyridyl group substituted, for example, with an alkyl, dialkylamino, cyclohexenyl, piperidinyl, pyridyl, carbonamido or alkylcarbonamido group, or Z is a thioureido, mercaptopyridyl, thiocarbamate or mercaptotetrazole, substituted, for example, with an alkyl or aryl group, any of the above groups of which may in turn be further substituted.

Each linking group L, when present, is independently selected from a divalent, trivalent or tetravalent group, such as a substituted or unsubstituted aromatic, alkylene, polyalkylene or polyalkylene oxide group or a substituted or unsubstituted alkylene or polyalkylene group separated by one or more heteroatoms selected from nitrogen, oxygen and sulfur, wherein the groups within L may be also separated one from each other by one or more substituted or unsubstituted alkyl, alkylene, polyalkylene, aryl or heterocyclic groups, such as a piperidino group. Each linking group L may include, linked to each carbonyl group, a terminal oxygen atom or a group NR', wherein R' is a hydrogen atom or a substituted or unsubstituted alkyl group. Preferred linking groups are, for example, the groups $$—NH(CH_2)_2NH—,\ —NH(CH_2)_6NH—,\ —(CF_2)_2—,\ —(CF_2)_3—,$$

$$—NH(CH_2)_2O(CH_2)_2O(CH_2)_2O(CH_2)_2NH—,\ —OC_6H_4C(CH_3)_2C_6H_4O—$$

and in particular the group $—NH(CH_2)_n—$ piperidino-$(CH_2)_nNH—$, wherein n is from 0 to 4 and especially 3.

The anionic counterion may be selected from any well-known in the art and may typically be selected from $Cl^-$, $Br^-$, $CF_3CO_2^-$, $CH_3SO_3^-$ and $TsO^-$ or their corresponding acids HCl, HBr, $CF_3CO_2H$, $CH_3SO_3H$ and TsOH. k is an integer from 0 to 8, preferably from 0 to 4.

When p and each n are 0, then m is 2 and the compound of formula (I) is of the oxalyl-type, typified by nucleator I-29 referred to the examples below. When p is 1, i.e. there is a linking group between the carbonyl groups, and each n is independently 0 or 1, then m is either 2, 3 or 4 and is typified by nucleator I-1 referred to the examples below.

Although for ease of synthesis it may be convenient for the nucleator to be symmetrical, asymmetrical nucleating agent structures are specifically within the scope of the present invention.

As used herein and throughout the specification, unless where specifically stated otherwise, the term "alkyl" refers to a saturated or unsaturated, straight or branched chain alkyl group including alkenyl and aralkyl, and includes cyclic groups, including cycloalkenyl, having 3-8 carbon atoms. The term "polyalkylene" refers to an alkylene group $(CH_2)_n$ wherein n is more than 10 and the term "aryl" includes fused aryl.

Unless otherwise specifically stated, substituent groups which may be substituted on molecules herein include any groups, whether substituted or unsubstituted, which do not destroy properties necessary for the photographic utility. When the term "group" is applied to the identification of a substituent containing a substitutable hydrogen, it is intended to encompass not only the substituent's unsubstituted form, but also its form further substituted with any group or groups herein mentioned. Suitably, the group may be halogen or may be bonded to the remainder of the molecule by an atom of carbon, silicon, oxygen, nitrogen, phosphorous or sulfur. The substituent may be, for example, halogen, such as chlorine, bromine or fluorine; nitro; hydroxyl; cyano; carboxyl; or groups which may be further substituted, such as alkyl, including straight and branched chain alkyl, such as methyl, trifluoromethyl, ethyl, t-butyl, 3-(2,4-di-t-pentylphenoxy) propyl and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy and 2-dodecyl-oxyethoxy; aryl, such as phenyl, 4-t-butyl-phenyl, 2,4,6-trimethylphenyl, naphthyl; aryloxy, such as phenoxy, 2-methylphenoxy, alpha- or beta-naphthyloxy and 4-tolyloxy; carbonamido, such as acetamido, benzamido, butyramido, tetradecanamido, alpha-(2,4-di-t-pentylphenoxy)acetamido, alpha-(2,4-di-t-pentyl-phenoxy)butyramido, alpha-(3-pentadecylphenoxy) hexanamido, alpha-(4-hydroxy-3-t-butylphenoxy) tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl and N-acetyl-N-dodecylamino, ethoxycarbonylamino, phenoxycarbonylamino, benzyloxycarbonylamino, hexadecyloxycarbonylamino, 2,4-di-t-butylphenoxy-carbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-di-phenylureido, N-phenyl-N-p-toluylureido, N-(m-hexadecylphenyl)urcido, N,N-(2,5-di-t-pentylphenyl)-N'-ethylureido and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoly and N-dodecylsulfamoyl; carbamoyl, such as N-methylcarbamoyl, N,N-dibutyl-carbamoyl, N-octadecylcarbamoyl, N-[4-(2,4-di-t-pentylphenoxy)butyl]-carbamoyl, N-methyl-N-tetradecylcarbamoyl and N,N-di-octylcarbamoyl; acyl, such as acetyl, (2,4-di-t-amylphenoxy)acetyl, phenoxycarbonyl, p-dodecyloxy-phenoxycarbonyl, methoxycarbonyl, butoxycarbonyl, tetradecyloxycarbonyl, ethoxycarbonyl, benzyloxycarbonyl, 3-pentadecyloxycarbonly and dodecyl-oxycarbonyl; sulfonyl, such as methoxysulfonyl, octyloxysulfonyl, tetradecyl-oxysulfonyl, 2-ethylhexyloxysulfonyl, phenoxysulfonyl, 2,4-di-t-pentyl-phenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl and p-toluylsulfonyl; sulfonyloxy, such as dodecylsulfonyloxy and hexadecyl-sulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl and p-toluylsulfinyl; thio, such as ethylthio, octylthio, benzylthio, tetradecylthio, 2-(2,4-di-t-pentylphenoxy)-ethylthio, phenylthio, 2-butoxy-5-t-octylphenylthio and p-tolylthio; acyloxy, such as acetyloxy, benzoyloxy, octadecanoyloxy, p-dodecylamidobenzoyloxy, N-phenylcarbamoyloxy, N-ethylcarbamoyloxy and cyclo-hexylcarbonyloxy; amino, such as phenylanilino, 2-chloroanilino, diethylamino and dodecylamino; imino, such as 1 (N-phenylimido)ethyl, N-succinimido or 3-benzyl-hydantoinyl; phosphate, such as dimethylphosphate and ethylbutylphosphate; phosphite, such as diethyl and dihexy-lphosphite; a heterocyclic group, a heterocyclic oxy group or a heterocyclic thio group, each of which may be substituted and which contain a 3 to 7 membered heterocyclic ring composed of carbon atoms and at least one heteroatom selected from the group consisting of oxygen, nitrogen and sulfur, such as 2-furyl, 2-thienyl, 2-benzimidazolyloxy or 2-benzothiazolyl; quartemary ammonium, such as triethylammonium; and silyloxy, such as trimethylsilyloxy.

If desired, the substituents may themselves be further substituted one or more times with the previously described substituent groups. The particular substituents used may be selected by those skilled in the art to attain the desired photographic properties for a specific application and can include, for example, hydrophobic groups, solubilizing groups, blocking groups, releasing or releasable groups. Generally, the above groups and substituents thereof may include those having up to 48 carbon atoms, typically 1 to 36 carbon atoms and usually less than 24 carbon atoms, but greater numbers are possible depending on the particular substituents selected.

Specific examples of nucleators useful in the present invention are represented below:

I-1

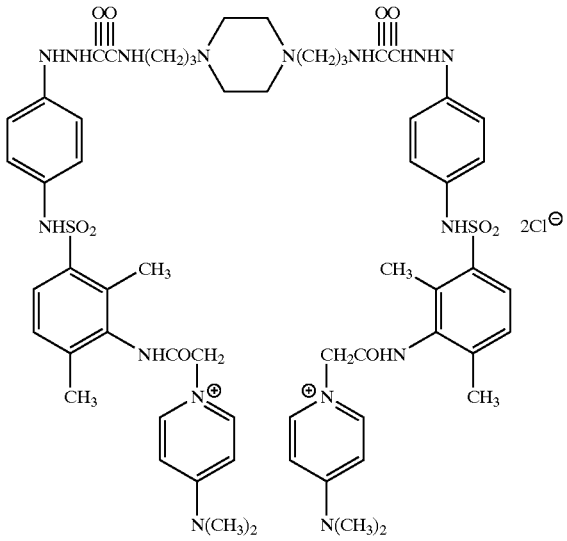

I-2

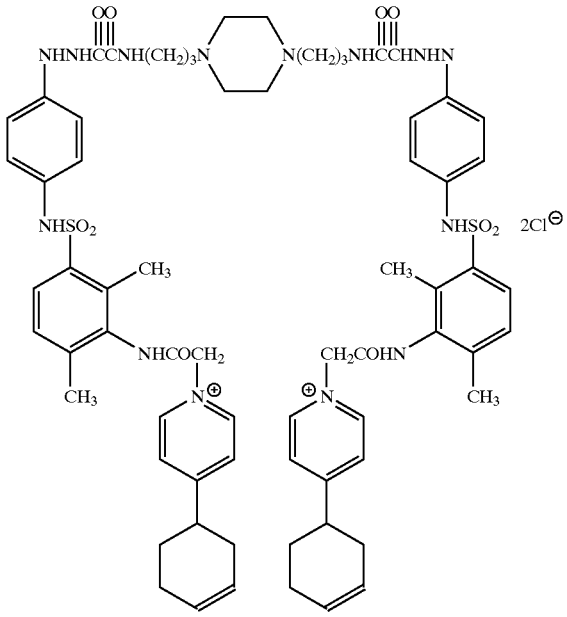

-continued

I-3

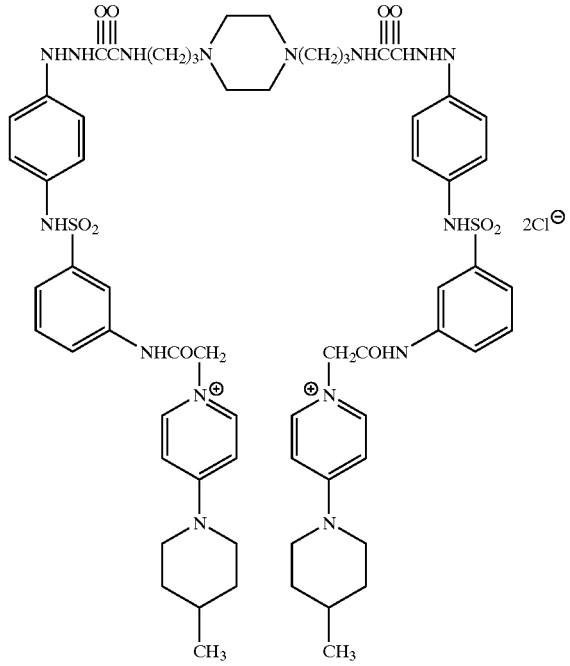

I-4

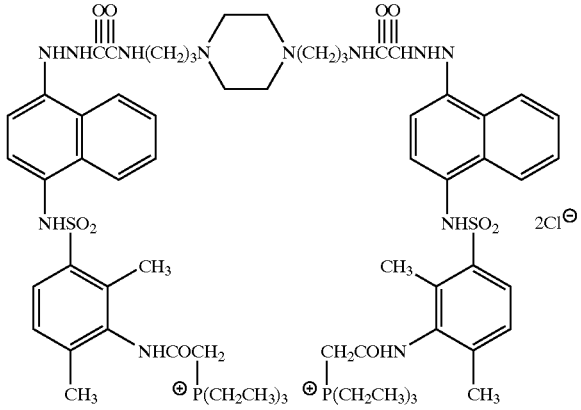

I-5

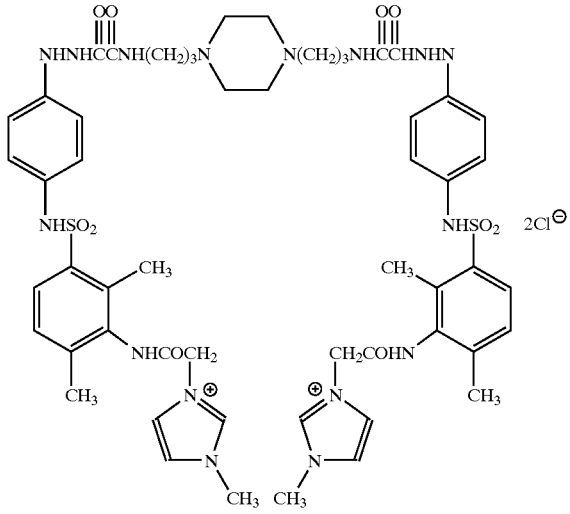

-continued
I-6
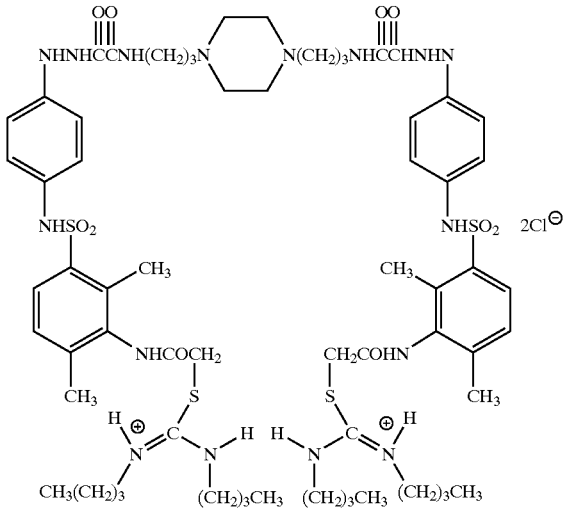
I-7
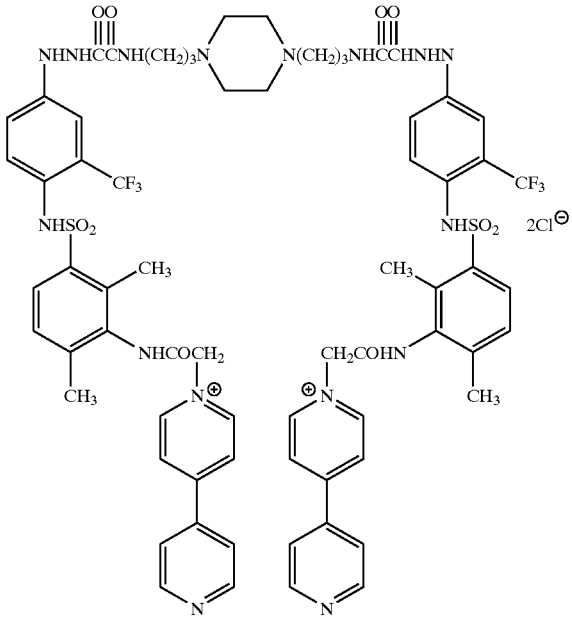
I-8
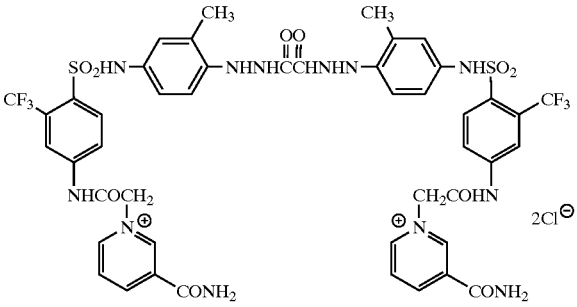
-continued
I-9
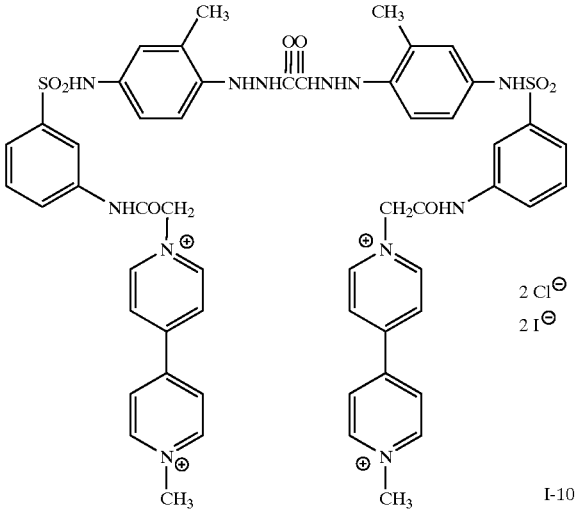
I-10
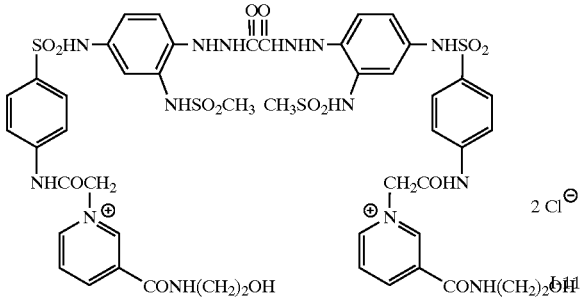
I-11
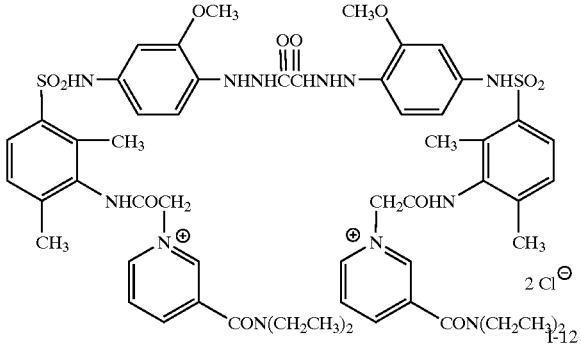
I-12
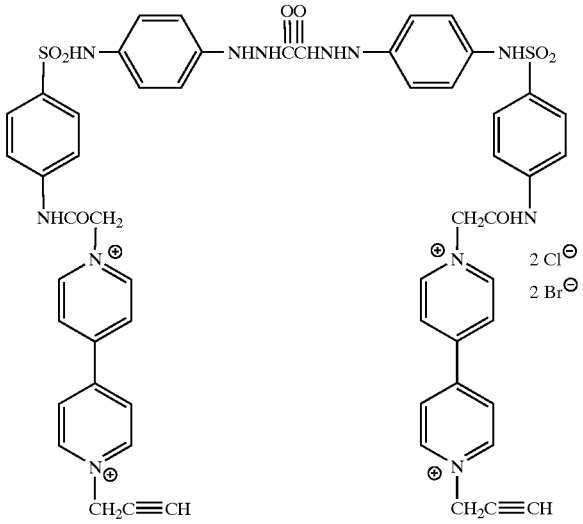

-continued
I-13
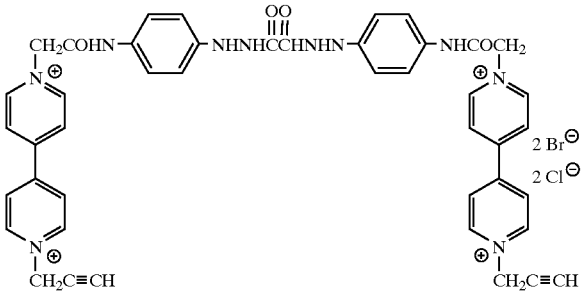
I-14
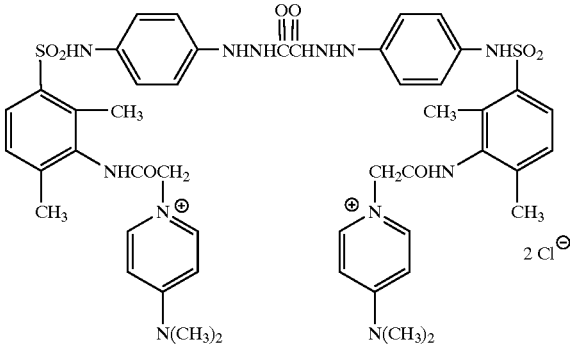
I-15
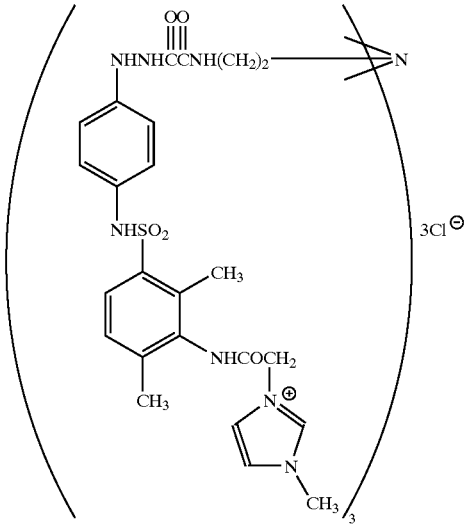
-continued
I-16
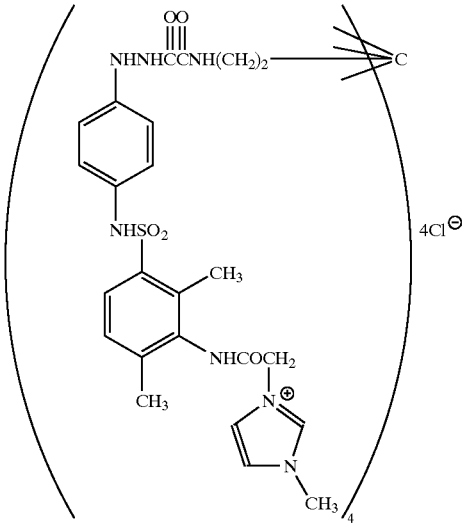
I-17
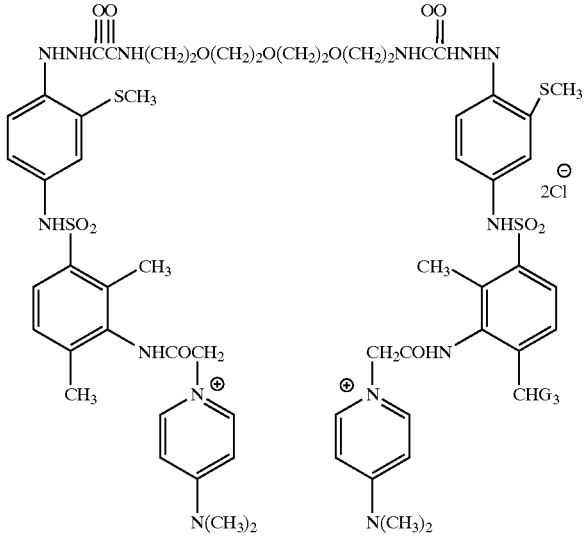
I-18
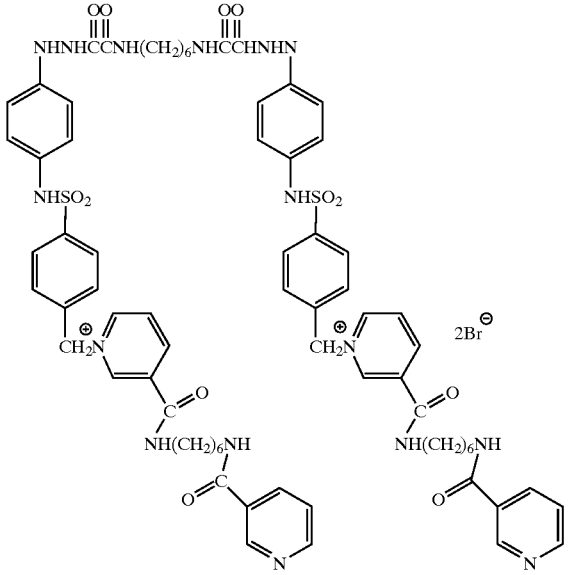

-continued
I-19
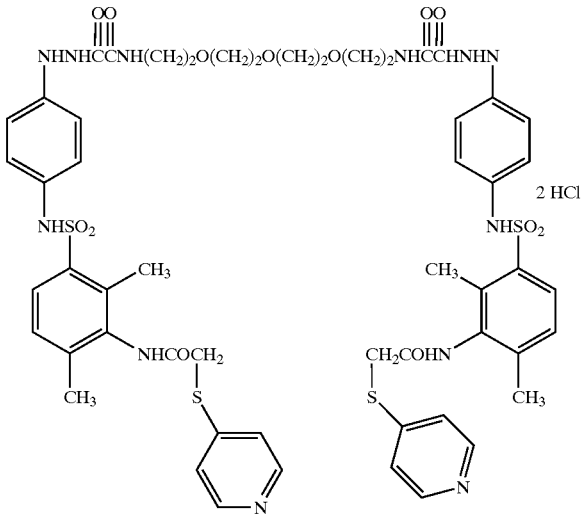
I-20
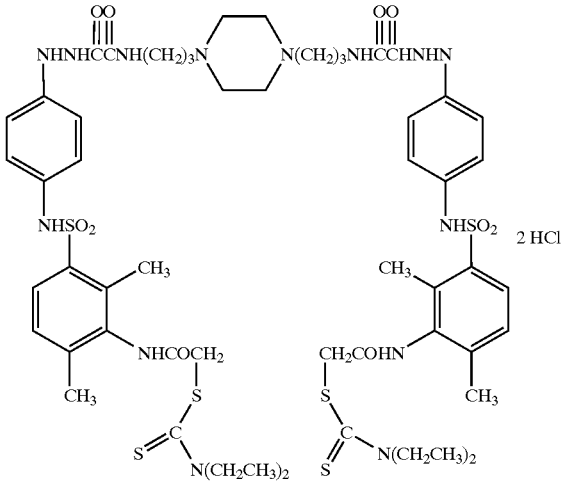
I-21
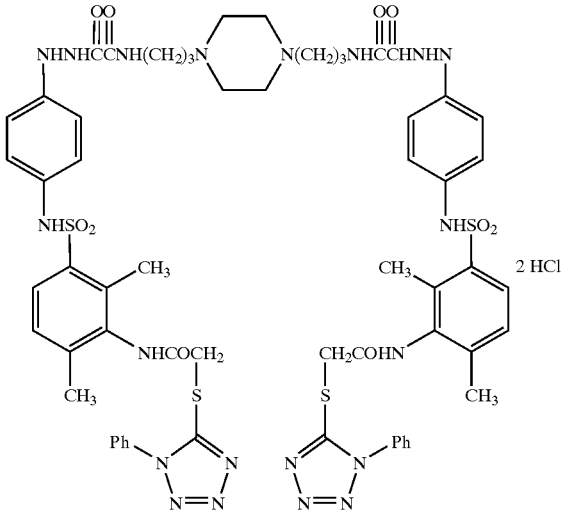
-continued
I-22
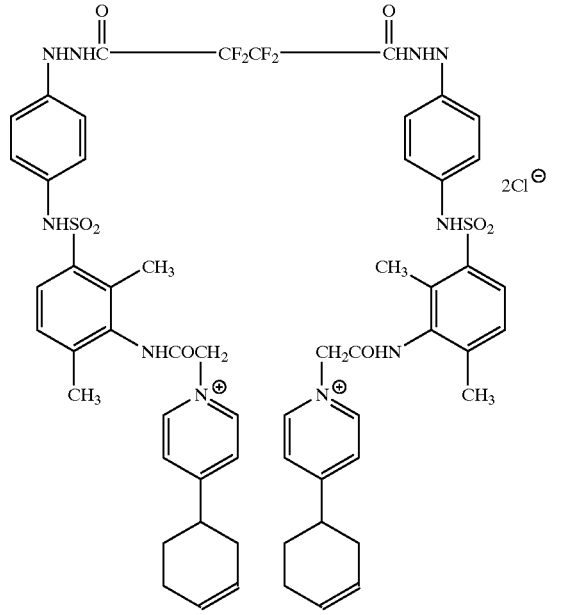
I-23
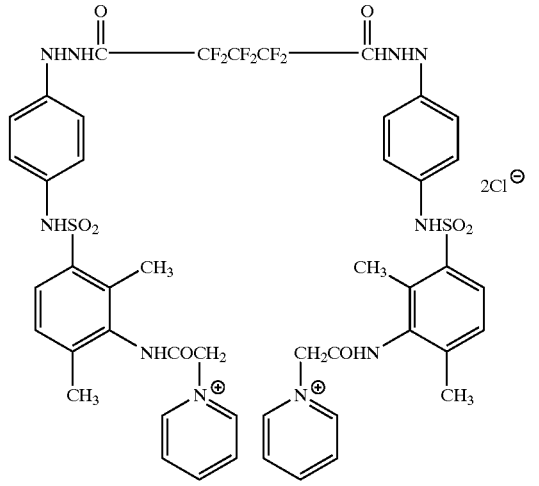
I-24
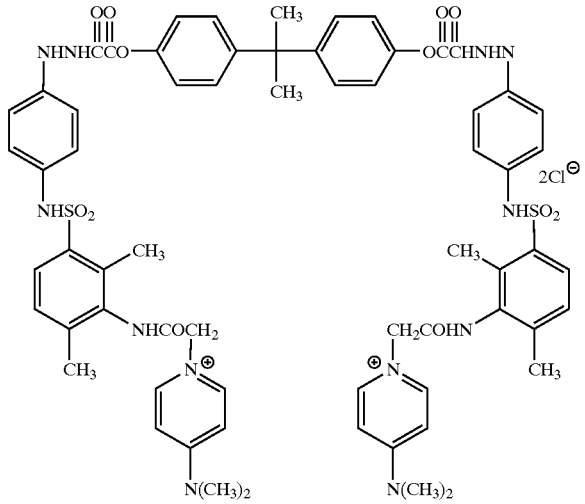

-continued
I-25
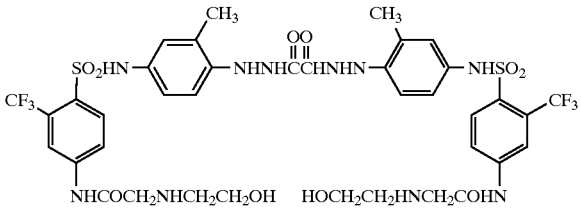
I-26
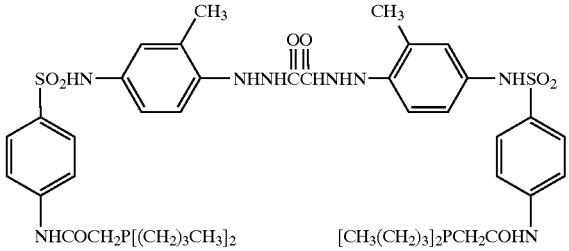
I-27
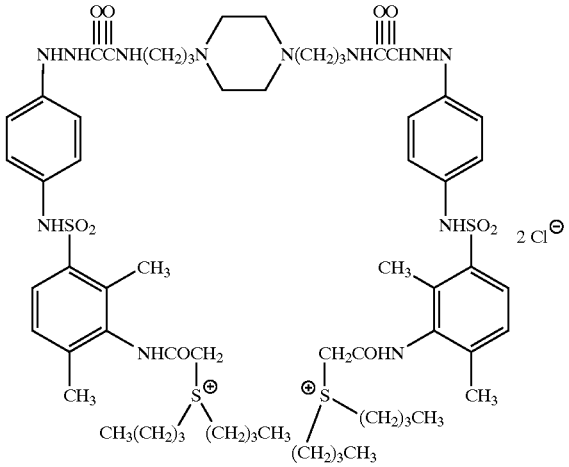
I-28
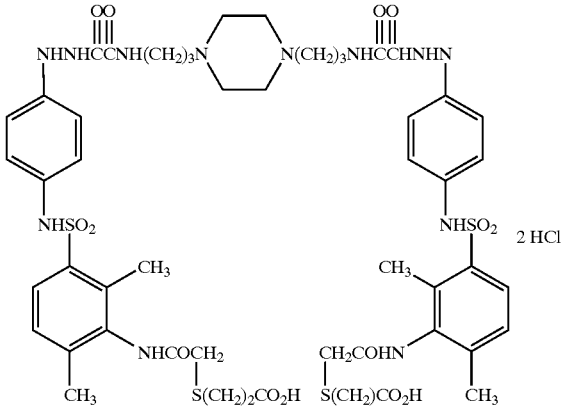
-continued
I-29
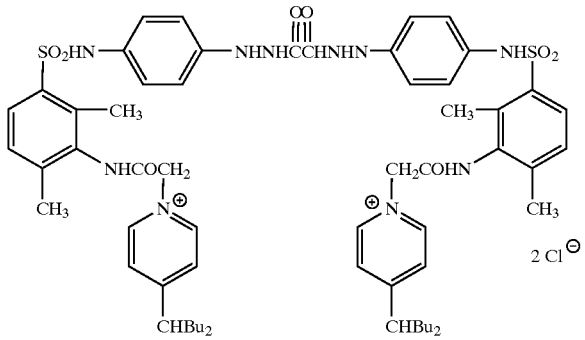
I-30
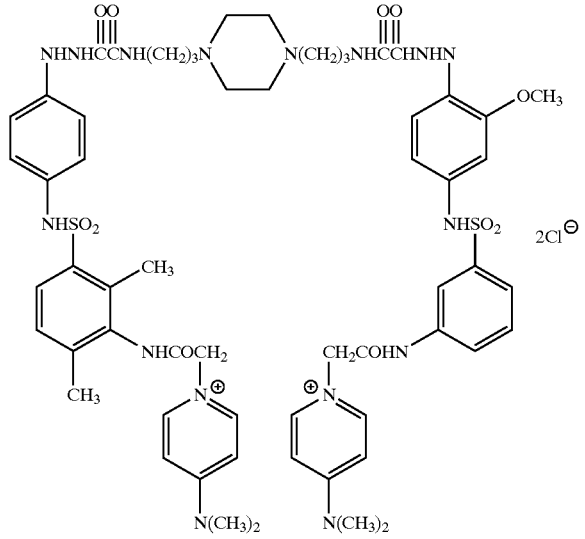
I-31
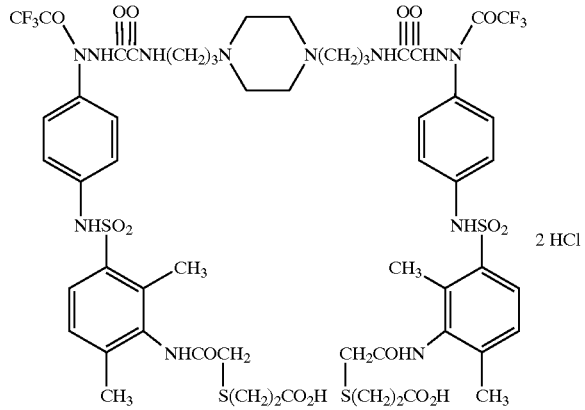

-continued
I-32
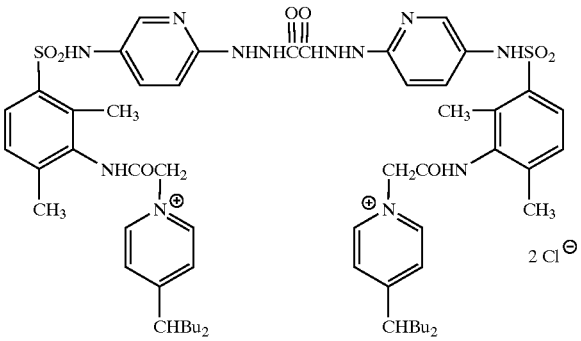
I-33
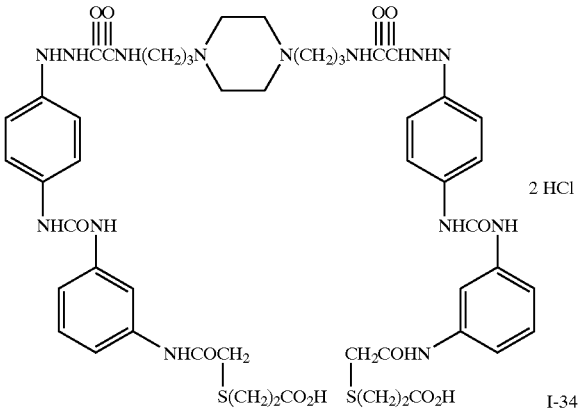
I-34
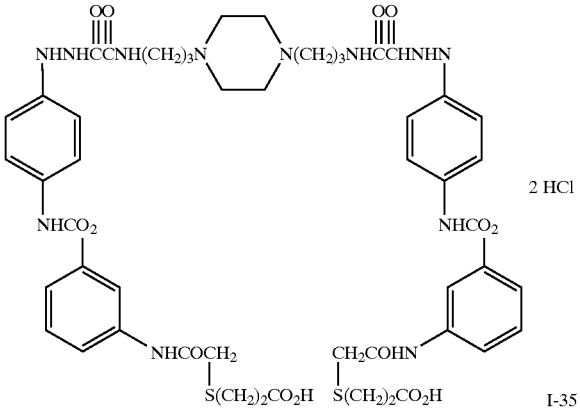
I-35
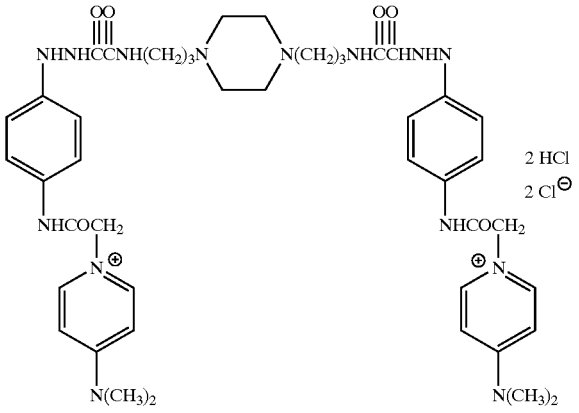
-continued
I-36
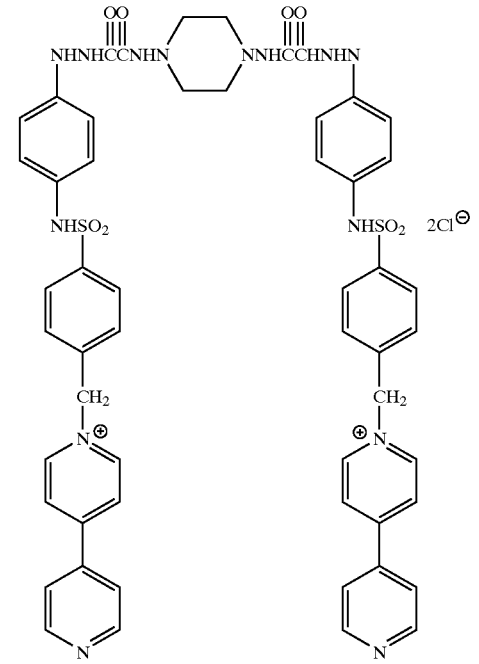
I-37
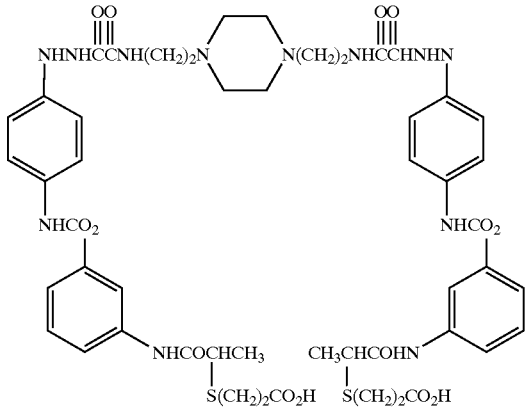
I-38
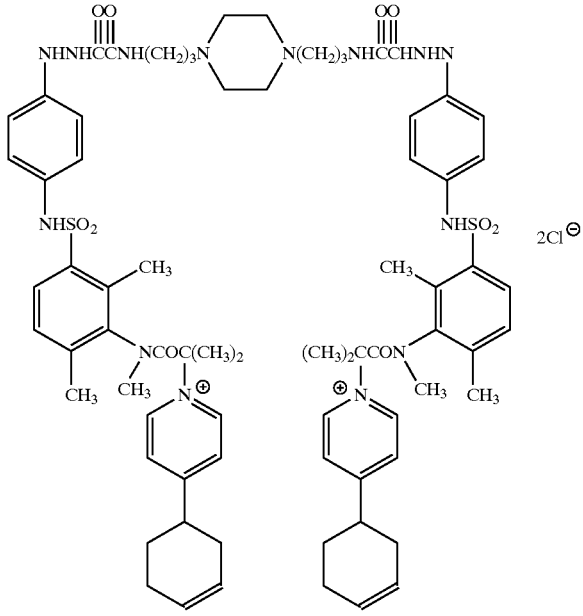

-continued

I-39

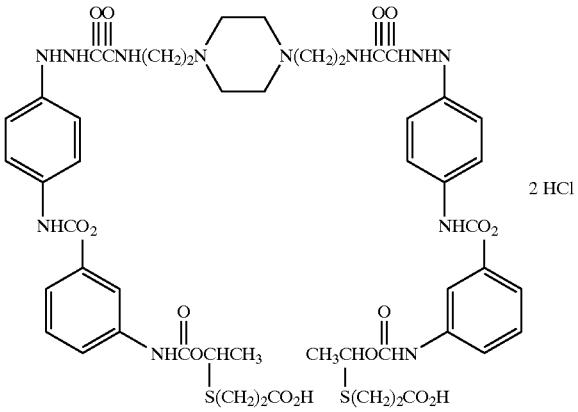

2 HCl

I-40

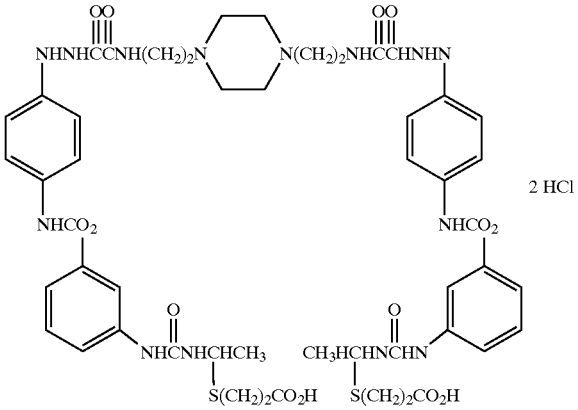

2 HCl

The photographic material used in the invention may also contain a booster compound to enhance the ultrahigh contrast and to promote activity. Alternatively, the booster compound can be present in the developer solution.

One class of such boosters is amines that (1) comprise at least one secondary or tertiary amino group, and (2) have a n-octanol/water partition coefficient (log P) of at least one, preferably at least three, and preferably at least four, log P being defined by the formula:

$$\log P = \log \frac{[X_{octanol}]}{[X_{water}]}$$

wherein

X is the concentration of the amino compound.

Preferably, such an amine contains within its structure a group comprising at least three repeating ethyleneoxy units as described in U.S. Pat. No. 4,975,354. These units are preferably directly attached to the nitrogen atom of a tertiary amino group.

Included within the scope of the amino compounds which may be utilized in the present invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amine boosters are compounds having at least 20 carbon atoms.

Preferred amino compounds for inclusion in photographic materials are bis-tertiary amines which have a partition coefficient of at least three and a structure represented by the formula:

$$R^1R^2N—(CH_2CH_2O)_n—CH_2CH_2—NR^3R^4$$

wherein n is an integer from 3 to 50, and more preferably from 10 to 50;

$R^1$, $R^2$, $R^3$ and $R^4$ are, independently, alkyl groups of 1 to 8 carbon atoms, or $R^1$ and $R^2$ taken together represent the atoms necessary to form a heterocycle, and/or $R^3$ and $R^4$ taken together represent the atoms necessary to complete a heterocyclic ring.

A particularly preferred booster for use in photographic materials or in the developer is the booster B1, wherein in the above formula $R^1$, $R^2$, $R^3$ and $R^4$ are each n-propyl groups and n is 14, and corresponding to the structure (B1)

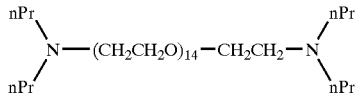

Another preferred group of amino compounds is bis-secondary amines which have a partition coefficient of at least three and a structure represented by the formula:

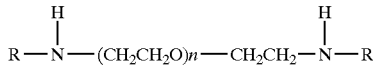

wherein n is an integer from 3 to 50, and more preferably from 10 to 50, and each R is, independently, a substituted or unsubstituted linear or branched alkyl group of at least 4 carbon atoms.

Particular amines suitable as booster compounds are listed in European Patent Application EP-A-0 364 166.

Other types of boosters are described in the U.S. Pat. No. 5,744,279 as having one of the formulae:

$$Y((X)_n—A—B)_m \quad (a)$$

wherein

Y is a group that adsorbs to silver halide,

X is a divalent linking group composed of hydrogen, carbon, nitrogen and sulfur atoms, A is a divalent linking group, B is an amino group which may be substituted or an ammonium group of a nitrogen-containing heterocyclic group, m is 1, 2 or 3 and n is 0 or 1, $$R^1R^2N—R^3—(X)_n—SM_x \quad (b)$$

wherein:

$R^1$ and $R^2$ are each independently hydrogen or an aliphatic group, or $R^1$ and $R^2$ may together form a ring, $R^3$ is a divalent aliphatic group, X is a divalent heterocyclic ring having at least one nitrogen, oxygen or sulfur atom as heteroatom, n is 0 or 1, $M_x$ is hydrogen or an alkali metal atom, alkaline earth metal atom, a quaternary ammonium, quaternary phosphonium atom or an amidino group, said compound optionally being in the form of an addition salt;

(c) a phosphonium structure as disclosed in U.S. Pat. No. 5,744,279 and as exemplified by the following formula:

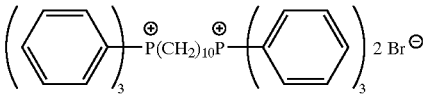

or (d) a pyridinium structure as described in U.S. Pat. No. 5,744,279 as exemplified by the following formula:

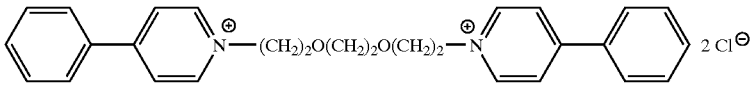

The nucleating agent and optionally the booster compound can be incorporated in the photographic material, for example it can be incorporated in a silver halide emulsion layer. Alternatively, it can be present in a hydrophilic colloid layer of the photographic material, preferably a hydrophilic layer which is coated to be adjacent to the emulsion layer in which the effects of the nucleating agent are desired. However, it can be present in the photographic material distributed between or among emulsion and hydrophilic colloid layers, such as undercoating layers, interlayers and overcoating layers.

Typically, the nucleating agent may be present in the photographic material in an amount of from 1 $\mu$mol/m$^2$ to about 100 $\mu$mol/m$^2$, preferably from 3 $\mu$mol/m$^2$ to 50 $\mu$mol/m$^2$, and more preferably from 5 $\mu$mol/m$^2$ to 20 $\mu$mol/m$^2$. Corresponding amounts for the booster are from 0 mol/m$^2$ to 1 mmol/m$^2$, preferably from 10 $\mu$mol/m$^2$ to 100 $\mu$mol/m$^2$, most preferably from 30 $\mu$mol/m$^2$ to 100 $\mu$mol/m$^2$.

The emulsions used in the photographic material used in the present invention and the addenda added thereto, the binders, supports, etc. may be as described in Research Disclosure Item 36544, September 1994, published by Kenneth Mason Publications, Emsworth, Hants, PO10 7DQ, United Kingdom, which will be identified hereinafter by the term "Research Disclosure."

The hydrophilic colloid may be gelatin or a gelatin derivative, polyvinylpyrrolidone or casein and may contain a polymer. Suitable hydrophilic colloids and vinyl polymers and copolymers are described in Section IX of the Research Disclosure. Gelatin is the preferred hydrophilic colloid. The photographic material may also contain a overcoat hydrophilic colloid layer which may also contain a vinyl polymer or copolymer located as the last layer of the coating (furthest from the support). It may contain one or more surfactants to aid coatability and may also contain some form of matting agent. The vinyl polymer is preferably an acrylic polymer and preferably contains units derived from one or more alkyl or substituted alkyl acrylates or methacrylates, alkyl or substituted alkyl acrylamides, or acrylates or acrylamides containing a sulphonic acid group.

The photographic material used in the present invention preferably contains an antihalation layer that may be on either side of the support, preferably on the opposite side of the support from the emulsion layer. In a preferred embodiment, an antihalation dye is contained in the hydrophilic colloid underlayer. The dye may also be dissolved or dispersed in the underlayer. Suitable dyes are listed in the Research Disclosure disclosed above.

The emulsions are preferably chemically sensitized, for example with both sulphur and gold. The latent image-forming grains can be bromoiodide, chlorobromoiodide, bromide, chlorobromide, chloroiodide or chloride, preferably chlorobromide. Preferably they should be spectrally sensitized. More than one type of spectrally sensitized silver halide grain may be present hence grains sensitized to different spectral regions may be present in the emulsion layer.

The coating may be made preferably by blending two or more emulsion melts containing grains of the required spectral sensitivity, allowing the production of multi-wavelength sensitive products and giving rise to manufacturing cost advantages through both material and inventory reduction. Combining the different emulsion grains within one layer can give improvements in process sensitivity over multilayer graphics nucleated systems, as described in European Patent Application EP-A-0 682 288.

The silver halide grains may be doped with rhodium, ruthenium, iridium or other Group VIII metals, either alone or in combination, preferably at levels in the range $10^{-9}$ to $10^{-3}$, preferably $10^{-6}$ to $10^{-3}$ mole metal per mole of silver. The grains may be mono- or poly-disperse. The preferred Group VIII metals are rhodium and/or iridium and ammonium pentachlororhodate may conveniently be used.

The photographic materials used in the present invention are particularly suitable for exposure by red or infrared laser diodes, light emitting diodes or gas lasers, for example helium/neon or argon lasers.

The light-sensitive silver halide contained in photographic products can be processed following exposure to form a visible image by associating the silver halide with an aqueous alkaline medium in the presence of a developing agent contained in the medium.

According to the present invention, the photographic material described above is developed in a hydroquinone-free developer, comprising a main developing agent of the ascorbic acid or ascorbic acid salt type, and as auxiliary developing agent a mixture of 3-pyrazolidones of which at least one has the formula (II) defined above.

In the present description, the term "ascorbic acid" includes compounds such as D- or L-ascorbic acid, sugar type derivatives thereof (such as the sorboascorbic acid, lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in publications U.S. Pat. No. 5,498,511 (Yamashita et al), EP-A-0 585,792, EP-A-0 573 700, EP-A-0 588 408, WO 95/00881, U.S. Pat. No. 5,089,819 and U.S. Pat. No. 5,278,035 (Knapp), U.S. Pat. No. 5,384,232 (Bishop et al), U.S. Pat, No. 5,376,510 (Parker et al), JP-A-756286, U.S. Pat. No. 2,688,549 (James et al), U.S. Pat. No. 5,236,816 and Research Disclosure, publication 37152, March 1995. D-, L-, or D,L-ascorbic acid (and alkali metal salts thereof) or isoascorbic acid (or alkali metal salts thereof) are preferred. Sodium ascorbate and sodium isoascorbate are most preferred. Mixtures of these developing agents can be used if desired.

The term "hydroquinone-free" means that the developer does not comprise polyhydroxybenzene type developing agents such as hydroquinone.

The term "3-pyrazolidone" preferably comprises, with the exception of the 3-pyrazolidones of formula (II), 1-phenyl-3-pyrazolidone, substituted or unsubstituted at 4- and 5-position, such as Dimezone or 4-methyl-4-hydroxymethyl-1-phenyl-3-pyrazolidone. Preferably, 4-methyl-4-hydroxymethyl-1-phenyl-3-pyrazolidone is used.

3-pyrazolidones of formula (II) have solubilizing groups that are not directly attached to the phenyl ring or pyrazolidino ring and are described in U.S. Pat. Nos. 5,780,212 and 5,942,379.

Examples of 3-pyrazolidone of formula (II) useful in the present invention have the following formulas:

(1)

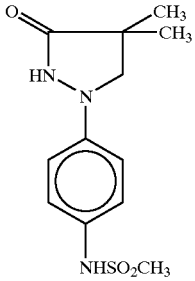

(2)

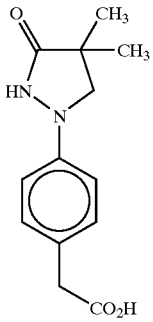

(3)

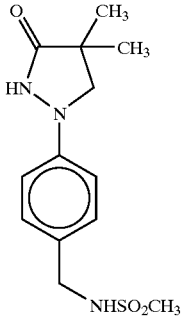

(4)

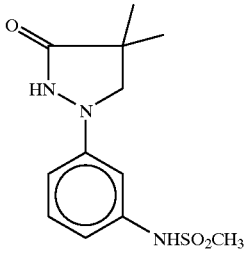

-continued (5)

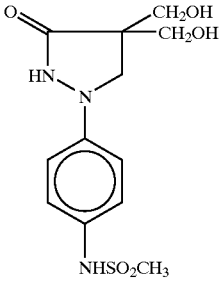

(6)

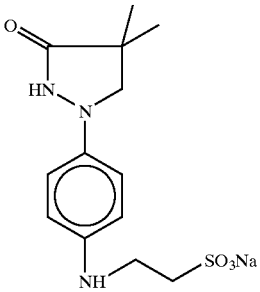

(7)

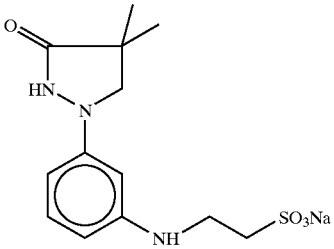

(8)

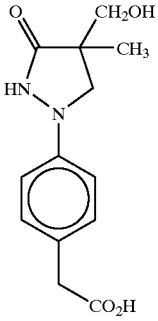

(9)

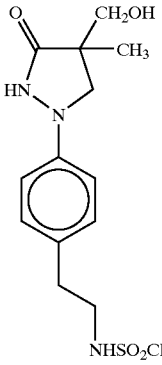

-continued
(10)
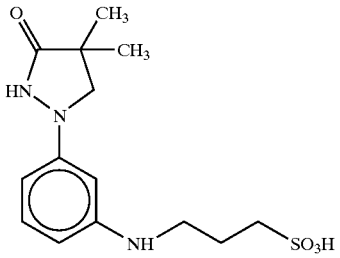
(11)
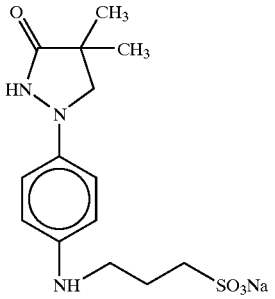
(12)
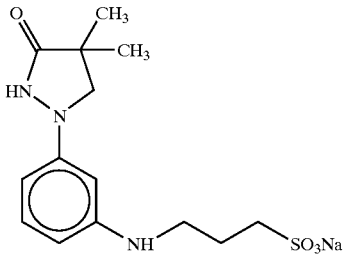
(13)
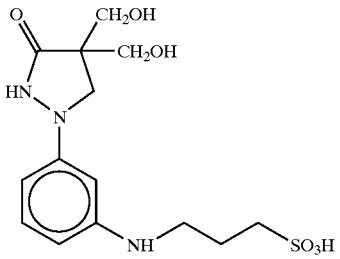
(14)
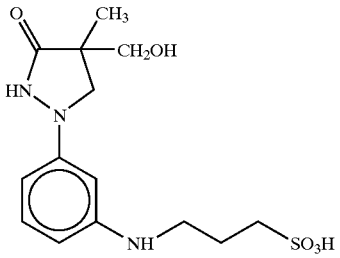
-continued
(15)
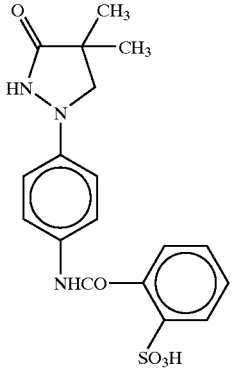
(16)
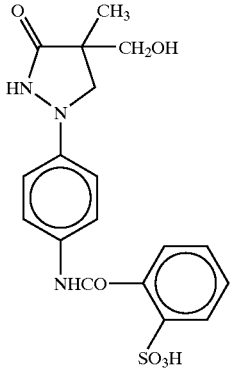
(17)
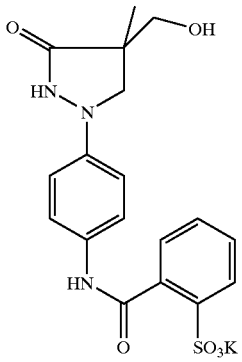
(18)
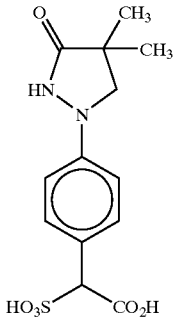

-continued (19)

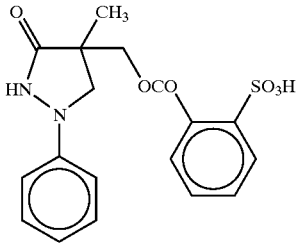

(20)

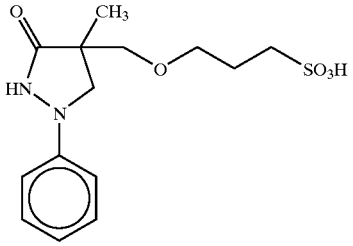

(21)

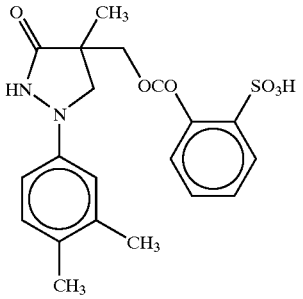

(22)

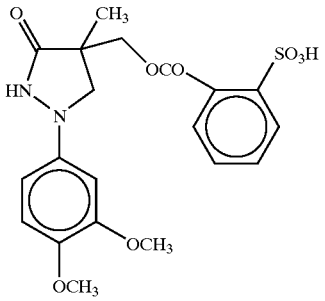

(23)

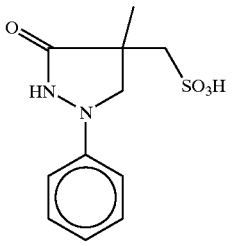

(24)

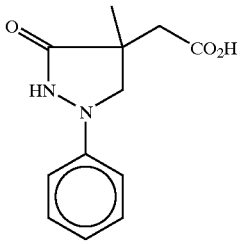

Preferably, at least one of the 3-pyrazolidones of formula (II) present in the auxiliary developing agent is the compound (16) or the compound (24).

The molar ratio of 3-pyrazolidones, except for the 3-pyrazolidones of formula (II), to 3-pyrazolidones of formula (II) is from 1:10 and 10:1, but is preferably near 1:1.

The amount of auxiliary developing agent present in the developer is from 0.1% to 5%, and preferably from 1% to 2%, by weight of the total weight of the developer.

The developer used in the present invention preferably has a pH below 11, preferably from 10.0 to 10.8, more preferably from 10.3 to 10.5 and more especially near 10.4.

The developer used in the present invention can include, in addition to the main developing agent and the auxiliary developing agent as defined above, a variety of conventional additives such as an antioxidant, a sequestering agent, a buffering agent, one or more inorganic antifoggants and one or more organic antifoggants, a solvent, a surfactant, one or more anti-silver sludge compounds, and other additives known to those skilled in the art.

Suitable organic antifoggants include, but are not limited to, benzimidazoles, benzotriazoles, mercaptotetrazoles, indazoles and mercaptothiadiazoles. Preferred antifoggants include the following compounds: 5-nitroindazole, 5-p-nitrobenzoyl-aminoimidazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-(2-mercapto-1,3,4-thiadiazol-2-yl-thio)butanesulfonate, 5-amino-1,3,4-thiadiazol-2-thiol, 5-methylbenzotriazole, benzotriazole and 1-phenyl-5-mercaptotetrazole.

The antioxidant can be sulfite or a compound capable of providing sulfite ions in aqueous solution. The antioxidant may be a sulfite, a bisulfite, or a metabisulfite. For example, alkali metal or ammonia salts, such as sodium sulfite, potassium sulfite, sodium bisulfite, potassium bisulfite, sodium, potassium or ammonium metabisulfite can be used.

The buffer or an agent capable of influencing the pH can be for example a carbonate, boric acid or a boric acid salt, or an alkanolamine.

Sequestering agents are used in principle to form stable complexes with free metal ions or traces of impurities in solution (such as silver, calcium, iron and copper ions) which can be introduced into the development bath in various ways. Sequestering agents, alone or in mixtures, are present in conventional amounts. Many useful sequestering agents are known in the art, but particularly useful compounds include, but are not limited to, polymer carboxylic acids, polyphosphonic acids and polyaminophosphonic acids, and any combinations of these compounds, as described in U.S. Pat. No. 5,389,502 (Fitterman et al), aminopolycarboxylic acids and polyphosphate ligands. Preferred sequestering agents include ethylenediaminetetraacetic acid, diethylenetriamine-pentaacetic acid, 1,3-propylenediaminetetraacetic acid, 1,3-diamino-2-propanoltetraacetic acid, ethylenediaminodisuccinic acid, ethylenediaminomonosuccinic acid, 4,5-dihydroxy-1,3-benzenedisulfonic acid, disodium salts (TIRON™), N,N'-1,2-ethanediylbis {N-[(2-hydroxyphenyl)methyl]} glycine ("HBED"), N-{2-[bis(carboxymethyl)amino]ethyl}-N-(2-hydroxyethyl) glycine ("HEDTA"), N-{2-[bis(carboxymethyl)amino]ethyl}-N-(2-hydroxyethyl) glycine, trisodium salts (available under the tradename VERSENOL™ from Acros Organics, Sigma Chemical or Callaway Chemical), and 1-hydroxy-ethylidenediphosphonic acid (available under the tradename DEQUES™ 2010 from Solutia Co.).

Photographic materials comprising nucleating agents of formula (I) developed with a developer comprising a main developing agent of ascorbic acid type, and as auxiliary developing agent a mixture of 3-pyrazolidones of which at least one is of the formula (II), present particularly high contrast.

More particularly, the method according to the present invention is performed with a photographic material comprising as formula (I) nucleating agent the compound I-1 or compound I-6, said exposed photographic material being developed in a developer comprising, as 3-pyrazolidone of formula (II), the compound 24. These combinations enable very high contrast to be obtained.

The developer used in the present invention may include a development accelerator such as those described in U.S. Pat. Nos. 5,474,879, and 5,384,232. A particularly preferred development accelerator is 1-phenethyl-2-picolinium bromide. 1-ethyl-pyridinium bromide and 1-propylpyridinium bromide are also appropriate. As a development accelerator, it is also possible to use thioethers having at least one ammonium group, triazolium thiolates or substituted thioalkanes, as described in U.S. Pat. No 5,837,434. The amount of development accelerator in the developer is from 0.01 to 1.0 g per liter of developer, preferably from 0.05 to 0.5 g/l. More particularly, the method according to the present invention is performed with a photographic material comprising as formula (I) nucleating agent the compound I-1, said exposed photographic material being developed in a developer comprising, as 3-pyrazolidone of formula (II), the compound 16, and as development accelerator 1-phenethyl-2-picolinium bromide. This combination enables very high contrast to be obtained.

The invention is illustrated by the following non-limiting examples:

EXAMPLES

I. Preparation of Nucleating Agent I-1

All the compounds prepared had infra-red, mass and NMR spectra which were in accordance with pure samples of the desired products.

The synthetic pathway to nucleating agent I-1 is described in detail below and illustrates the general method by which other examples wherein there is a linking group L may be prepared.

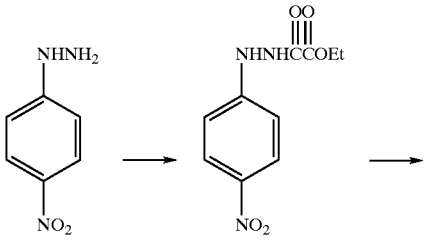

-continued

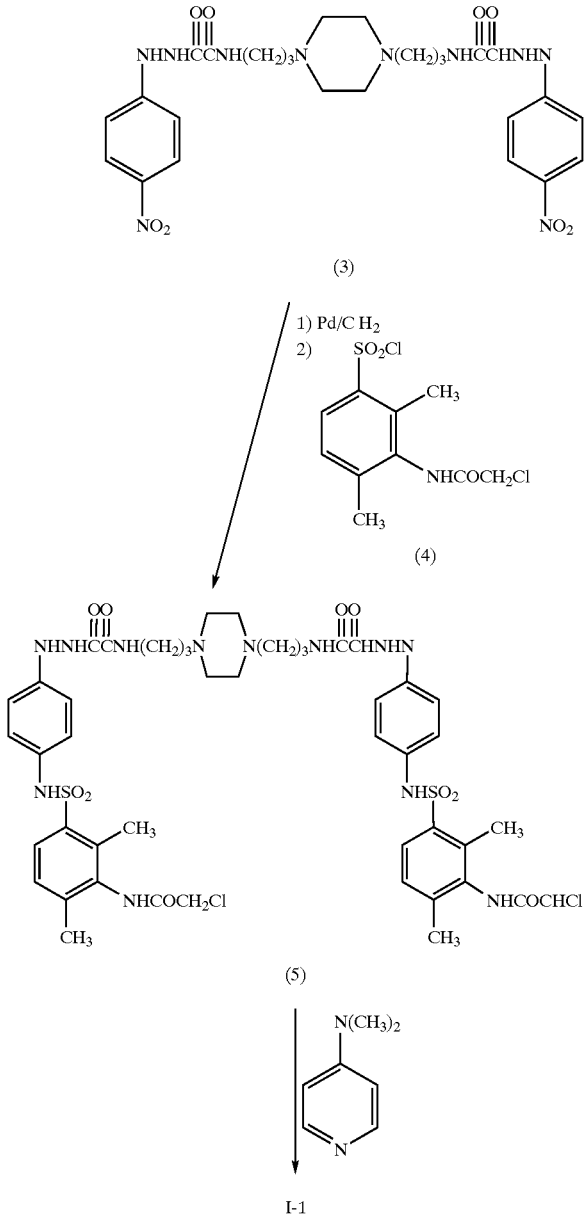

Preparation of Intermediate (2)

To a mixture of 4-nitrophenylhydrazine (1) (110.0 g, stabilised with 10% water, 0.653 mol) and dimethylaniline (83.1 g, 0.685 mol) in ethyl acetate (1.2 l) ethyl chlorooxoacetate (98.1 g, 0.718 mol) was added dropwise over the course of 2.25 h at 0-5° C. The mixture was left at ambient temperature overnight. The reaction mixture was warmed to give a solution, washed twice with diluted aqueous hydrochloric acid (2×500 ml, 1.0 M) and then with diluted aqueous sodium chloride (2×500 ml, 1.0 M). Solution was concentrated in vacuo to about a quarter of the volume, diluted with heptane (780 ml) and then chilled to ensure complete precipitation of the product. The product was filtered, washed with a 30/70 ethyl acetate/heptane mixture, air dried, then dried in a vacuum dessicator. Yield=129.3 g (78%).

Preparation of Intermediate (3)

Intermediate (2) (27.8 g, 0.11 mol) was dissolved in methanol (500 ml) and stirred under nitrogen. 1,4-Bis(3-aminopropyl)piperazine (10.0 g, 0.05 mol) was added and the solution was heated to reflux in a hot oil bath (at 90° C.) overnight under a good flow of nitrogen. The stirred solution was allowed to cool slowly to ambient temperature and filtered. The product was obtained as a dark purple solid. The lumpy solid was crushed and the residues were washed well with methanol in the filter funnel. The product was dried in a vacuum dessicator. Yield=28.2 g (92%).

Preparation of Intermediate (4)

Intermediate (4) was prepared according to the method described in U.S. Pat. No. 4,988,604, entitled "High-contrast silver halide photographic material containing hydrazide".

Preparation of Intermediate (5)

Intermediate (3) (10.0 g, 0.0163 mol) was dissolved in dimethylacetamide (200 ml) with a palladium/carbon catalyst (10%) (1.8 g).

The mixture was hydrogenated overnight under 32 atmospheres of hydrogen. The amine solution was filtered through a bed of Kieselguhr under suction into a Buchner flask containing the solid sulfonyl chloride (4) (9.5 g, 0.032 mol) and a catalytic amount of 4-(dimethylamino)pyridine (50 mg). Nitrogen was bubbled through the mixture, which was the allowed to stand overnight. The reaction mixture was filtered under gravity through a fine filter paper, to remove a little residual catalyst, into a stirred solution of sodium hydrogen carbonate (20 g) in water (2.5 l). A pinkish-white precipitate appeared that was stirred for 1 hour then filtered, washed with water and dried at the pump. The product was dried in a vacuum dessicator over phosphorous pentoxide. Yield=15.1 g (86%).

Preparation of nucleating agent I-1

Intermediate (5) (1.0 g, 0.00093 mol) was dissolved in dimethylacetamide (5 ml) with 4-(dimethylamino)pyridine (0.57 g, 0.00465 mol) under nitrogen and heated to 70° C. in an oil bath with stirring for 1 hour. The reaction mixture was allowed to cool to ambient temperature under nitrogen and then poured into di-isopropyl ether (0.7 l) with stirring. A pink colored solid formed that was filtered, washed with di-isopropyl ether and dried in vacuo in a dessicator overnight. Methanol (30 ml) was added to the product to dissolve it and the solution was poured into di-isopropyl ether (700 ml) with stirring. A solid formed and this was filtered and washed in di-isopropyl ether. The resulting pink colored solid was dried overnight in a vacuum dessicator. Yield=0.55 g (45%).

It can be seen from the above preparation of nucleating agent I-1 that, by using a 2.5-fold excess of 4-(dimethylamino) pyridine the reaction may be driven rapidly to completion within one hour to give a product of consistent composition, i.e. the reaction is robust.

II. Preparation of Co-Developer Compound 24

Triethylamine (3.2 g, 30.9 mmol) was added at ambient temperature under nitrogen to a solution of 4-methyl-1-phenyl-3-pyrazolidone (5 g, 28.4 mmol) and t-butyldimethylsilyl chloride (5.3 g, 33.3 mmol), in a mixture of dry toluene (70 ml) and dry THF (15 ml). 4-dimethylaminopyridine (0.03 g) and diazabicycloundecene (0.03 g) were added to this mixture, followed by heating to reflux under nitrogen for 24 hours. The mixture was then cooled to ambient temperature; a white precipitate formed that was suction filtered and washed with diethylether. The filtrate was concentrated under reduced pressure and then diethyl ether was added. The white precipitate formed was filtered again and the solvent removed under reduced pressure. The crude oil was then filtered using a silica gel with an ethyl acetate/petroleum 1:1 mixture. The filtrate was evaporated by drying under reduced pressure to give a compound (a) (8.1 g, 98%) as a clear yellow oil.

A solution of compound (a) (1.0 g, 3.45 mmol) in dry THF (10 ml) was cooled to −78° C. under nitrogen. A solution of n-butyllithium in hexane (1.6 M, 2.5 ml, 4 mmol) at −78° C. were added to this solution by successive additions with stirring. An orange-yellow solution formed (compound (b)). This solution was maintained at −78° C. for the next reaction.

A solution of n-butyllithium in hexane (1.6 M, 2.5 ml, 4 mmol) at −78° C. under nitrogen was added by successive additions into a separate container containing a solution of bromoacetic acid, (0.48 g, 3.45 mmol) in dry THF (7 ml). A white precipitate formed immediately and the suspension was stirred for 5 minutes more after the end of the addition. The orange-yellow solution prepared above (compound (b)) was then added quickly to the resulting suspension using a syringe. The mixture was stirred at −78° C. for 1.5 hours and then heated gradually to −20° C. over a period of 1.5 hours. Still under nitrogen, water (3 drops) then diluted HCl (3 drops) were added to the resulting mixture with rapid stirring. The resulting mixture was poured rapidly into a mixture of water/ice (50 ml) and concentrated HCl (2 ml) mixture and was stirred overnight at ambient temperature. The resulting mixture was extracted with ethyl acetate (3×70 ml), washed with water (50 ml) and then dried on magnesium sulfate. The solvent was removed under reduced pressure to obtain a yellow viscous oil (1.07 g). Diethylether was added to this crude material to obtain a white precipitate, that was collected by filtration and then vacuum dried. Compound 24 was isolated as a white solid (0.21 g, 26%).

III. Preparation of Co-Developer Compound 16 a) 2,2-bis(hydroxymethyl)propionic acid (67 g, 0.5 mol) was added to thionyl chloride (138 ml, 1.9 mol) at ambient temperature and then heated to reflux for 4 hours with stirring. A clear colorless solution was obtained that was cooled to ambient temperature, then the excess thionyl chloride was removed under reduced pressure. A pale yellow liquid was obtained. The crude product was purified by vacuum distillation to give 84.2 g (85%) of compound (a) as a clear colorless solution.

b) To a solution of 4-nitrophenylhydrazine (136.4 g, 0.892 mol) in dry pyridine (500 ml) were added compound (a) (177.1 g, 0.892 mol) and hydrochloric acid by successive additions at 5° C. under nitrogen and with stirring. The addition rate was such that the internal temperature was held below 10° C. When the addition was finished, the mixture was stirred at 5° C. for 1 hour, then at ambient temperature for 1 hour and then at 95° C. for 2.5 hours. The resulting mixture was cooled, poured into a 15% solution of HCl (6 l) with stirring, and then stirred for one hour. A yellow solid was collected by suction filtration, which was washed with water (3 l) then dried under vacuum on phosphorous pentoxide. 189.6 g (84.7%) of compound (b) was obtained as an orange-yellow powder.

c) A mixture of this compound (b) (40 g, 0.16 mmol) and palladium carbon (3.2 g, 10% Pd) in tetrahydrofuran (400 ml) was hydrogenated under 30 atmospheres of hydrogen at 45° C. for 4 hours and then at ambient temperature for 24 hours. The catalyst was filtered and the solvent removed under reduced pressure. Compound (c) was obtained as a green sludge. This crude product (c) was used immediately for the following reaction without further purification.

d) 0.16 mol of compound (c) were dissolved in acetonitrile (400 ml). A greenish solution was obtained. A solution of cyclic anhydride of 2-sulfobenzoic acid (14.7 g, 0.08 mol) into acetonitrile (60 ml) was added by successive additions with rapid stirring. A precipitate formed immediately. Triethylamine (8 g, 0.08 mol) was added and the precipitate disappeared to give a blue solution. Other additions were performed in the following manner:

7.4 g anhydride in 30 ml acetonitrile and 4 g triethylamine 3.7 g anhydride in 20 ml acetonitrile and 2 g triethylamine 1.85 g anhydride in 10 ml acetonitrile and 1 g triethylamine 1.85 g anhydride in 10 ml acetonitrile and 1 g triethylamine 1.85 g anhydride in 10 ml acetonitrile and 1 g triethylamine After these additions, a pink solution was obtained with a slightly sticky green deposit. The pink solution was separated from the green deposit by settling and stirred at ambient temperature. A white precipitate formed slowly. The suspension was stirred overnight at ambient temperature. The product was collected by suction filtration, washed with acetonitrile then vacuum dried. 48 g (59.6%) of triethylamine 2-[[[4-[4-(hydroxymethyl)-4-methyl-3-oxo-1-pyrazolidinyl]phenyl]amino]carbonyl] benzenesulfonic acid were obtained as a white solid (compound (16)).

Examples 1-2

Preparation and Evaluation of Coatings Incorporating Nucleating Agent I-1 or Nucleating Agent I-6 Developed by Compound 24

For comparative purposes, a nucleating agent C-1 was used that is the monomeric hydrazide analogue of the dimeric nucleating agent I-1.

C-1

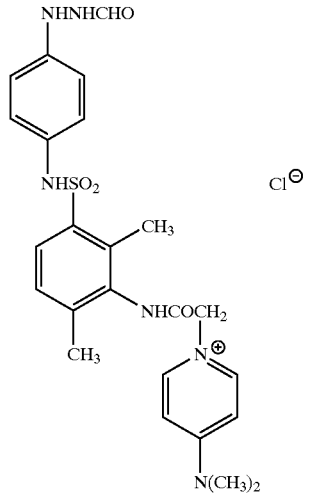

The nucleating agent I-1 or I-6 and comparison nucleating agent C-1 were individually dissolved in water and separately mixed with a gelatin binder for coating over a red-sensitized silver chlorobromide photographic emulsion on a transparent ESTAR™ support carrying an antihalation pelloid backing layer. A protective gelatin supercoat layer (1.0 g/m$^2$ gelatin), which also contained matte beads and surfactants to aid coatability, was applied over the layer containing the nucleating agent.

The nucleating agents were incorporated at a level of 0.538 mmol/m$^2$ and the layer also contained a nucleation booster compound (B1), at 45 mg/m$^2$ and gelatin at 0.65 g/m$^2$.

(B1)

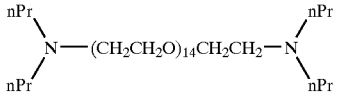

The emulsion layer contained 3.3 g Ag/m$^2$ of a 70/30 silver chlorobromide cubic monodispersed emulsion (0.16 $\mu$m edge length) uniformly doped with ammonium pentachlororhodate at $4.4\times10^{-7}$ mol/Ag mol and with dipotassium hexachloroiridate at $6\times10^{-7}$ mol/Ag mol. The emulsion was chemically sensitized with sulfur and gold and spectrally sensitized with 350 mg/Ag mol of sensitizing dye (S1).

(S1)

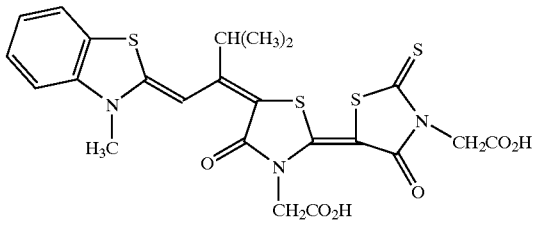

Various addenda to control photographic performance were included in the emulsion layer, namely 2-mercaptomethyl-5-carboxy-4-hydroxy-6-methyl-1,3,3a,7-tetraazaindene (644 mg Ag/mol); 2-mercaptomethyl-4-hydroxy-6-methyl-1,3,3a,7-tetraazaindene (100 mg Ag/mol); 1-(3-acetoamidophenyl)-5-mercaptotetrazole (20 mg Ag/mol); 4-(2,3-dihydro-2-thioxo)-4'-thiazoloacetic acid (53 mg Ag/mol) and 4,5-dihydroxy-1,3-benzenedisulfonic acid, disodium salt (2.39 mg Ag/mol). The layer also contained gelatin (2.65 g/m$^2$) and a methyl acrylate latex (0.58 g/m$^2$).

A comparison coating containing no nucleating agent, but otherwise identical to those described above was prepared in the same way.

Sensitograms of the various coatings were exposed by means of a red laser sensitometer and developed using developer DEV 1 comprising as main developing agent sodium erythorbate and as auxiliary developing agent a mixture of 4-methyl-4-hydroxymethyl-1-phenyl-3-pyrazolidone and compound 24, as 3-pyrazolidone of formula (II), and using for comparative purposes developer DEV AA comprising as main developing agent sodium erythorbate and as auxiliary developing agent a mixture of 4-methyl-4-hydroxymethyl-1-phenyl-3-pyrazolidone, corresponding to formulations given in table I below:

TABLE I

| | DEV AA (1 L) | DEV 1 (1 L) | DEV 2 (1 L) |
|---|---|---|---|
| Sodium metabisulfite | 7.60 g | 7.60 g | 7.60 g |
| Sodium bromide | 3.80 g | 3.80 g | 3.80 g |
| Diethyltriaminepentaacetic acid, pentasodium salt | 10.00 g | 10.00 g | 10.00 g |
| Polymaleic acid | 3.25 g | 3.25 g | 3.25 g |
| Benzotriazole | 0.28 g | 0.28 g | 0.28 g |
| Phenylmercaptotetrazole | 0.03 g | 0.03 g | 0.03 g |
| Diethylene glycol | 55.00 g | 55.00 g | 55.00 g |
| Potassium carbonate | 58.80 g | 58.80 g | 58.80 g |

TABLE I-continued

| | DEV AA (1 L) | DEV 1 (1 L) | DEV 2 (1 L) |
|---|---|---|---|
| Sodium erythorbate | 43.00 g | 43.00 g | 43.00 g |
| 4-methyl-4-hydroxymethyl-1-phenyl-3-pyrazolidone | 2.25 g | 1.125 g | 1.125 g |
| Co-developer compound 24 | — | 1.28 g | — |
| Co-developer compound 16 | — | — | 2.76 g |
| 1-phenethyl-2-picolinium bromide | — | — | 0.78 g |
| Potassium hydroxide 50% | 4.67 g | 4.67 g | 4.67 g |
| pH | 10.44 | 10.44 | 10.44 |

The fixer used after the development was Kodak ™ RA3000 fixer diluted 1 + 3.

The processing temperature was 35° C., and the processing sequence as follows:

Development: 30 sec

Fixing: 45 sec

Washing: 150 sec

The sensitometric curves of the developed sensitograms were obtained by means of a diode strip densitometer. Appropriate sensitometric parameters to use to compare the respective performance of each film/developer combination were "Sp.(0.6)", which is the relative speed measured at 0.6 density units above $D_{min}$, and "AveGr", which is the contrast measured between 0.7 and 1.3 density units above $D_{min}$.

These two parameters, as well as $D_{min}$ are given in table II below:

TABLE II

| Nucleating agent | Parameters | DEV AA | DEV 1 |
|---|---|---|---|
| — | $D_{min}$ | 0.027 | 0.026 |
| | Sp. (0.6) | −0.771 | −0.794 |
| | AveGr | 5.39 | 5.38 |
| C-1 | $D_{min}$ | 0.030 | 0.028 |
| | Sp. (0.6) | −0.642 | −0.647 |
| | AveGr | 14.82 | 13.60 |
| | | | Ex. 1 (Inv.) |
| I-1 | $D_{min}$ | 0.029 | 0.027 |
| | Sp. (0.6) | −0.634 | −0.630 |
| | AveGr | 18.40 | 19.99 |
| | | | Ex. 2 (Inv.) |
| I-6 | $D_{min}$ | 0.027 | 0.027 |
| | Sp. (0.6) | −0.634 | −0.632 |
| | AveGr | 18.58 | 21.47 |

The figures in Table II show that the combination in Examples 1 and 2 of nucleating agents of formula I-1 or I-6 and a developer comprising as auxiliary developing agent a mixture of 4-methyl-4-hydroxymethyl-1-phenyl-3-pyrazolidone and compound 24 enables higher contrast to be obtained than these same nucleating agents but used with a developer comprising as auxiliary developing agent only 4-methyl-4-hydroxymethyl-1-phenyl-3-pyrazolidone, and the same developer but with nucleating agents of the prior art.

EXAMPLE 3

Evaluation of Coatings Incorporating Nucleating Agent I-1 Developed by Compound 16

Coatings containing nucleating agent I-1 and nucleating agent C-1 respectively as described in examples 1-2 were used. Sensitograms of these various coatings were exposed using a red laser sensitometer and developed using developer DEV 2 whose formulation is given in table I. DEV 2 comprises as auxiliary developing agent a mixture of 4-methyl-4-hydroxymethyl-1-phenyl-3-pyrazolidone and compound 16, as 3-pyrazolidone of formula (II), and a development accelerator which was 1-phenethyl-2-picolinium bromide, the rest of the processing being identical to that of examples 1-2.

For comparative purposes, the sensitograms of identical coatings were developed but without nucleating agent.

Sensitometric curves were obtained and the same parameters as those of examples 1-2 were found. The results are given below in Table III.

TABLE III

| Nucleating agent | Parameters | DEV AA | DEV 2 |
|---|---|---|---|
| — | $D_{min}$ | 0.027 | 0.027 |
| | Sp. (0.6) | −0.771 | −0.726 |
| | AveGr | 5.39 | 5.57 |
| C-1 | $D_{min}$ | 0.030 | 0.028 |
| | Sp. (0.6) | −0.642 | −0.591 |
| | AveGr | 14.82 | 17.14 |
| | | | Ex. 3 (Inv.) |
| I-1 | $D_{min}$ | 0.029 | 0.030 |
| | Sp. (0.6) | −0.634 | −0.4920 |
| | AveGr | 18.40 | 19.60 |

Again, the figures in Table III show that the combination in Example 3 of a nucleating agent of formula I-1 and a developer comprising as auxiliary developing agent a mixture of 4-methyl-4-hydroxymethyl-1-phenyl-3-pyrazolidone, compound 16 and a development accelerator enables higher contrast to be obtained than with the same nucleating agent but used with a developer comprising as auxiliary developing agent only 4-methyl-4-hydroxymethyl-1-phenyl-3-pyrazolidone, and the same developer but with nucleating agents of the prior art.

What is claimed is:

1. A method for developing an exposed high contrast photographic material, said photographic material comprising a support bearing at least one silver halide emulsion layer, containing at least one hydrazide nucleating agent, characterized in that a) said nucleating agent has the formula (I):

(I)

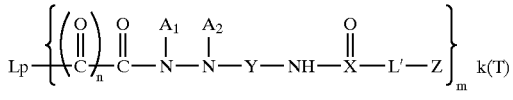

wherein each $A_1$ and each $A_2$ is independently selected from the class consisting of a hydrogen atom, or a substituted or unsubstituted acyl, or alkyl- or aryl-sulfonyl group;

each Y is independently selected from a substituted or unsubstituted aryl or heterocyclic ring or ring system;

each X is independently selected from S═O, C, C—NH and C—O;

each L' is independently selected from a substituted or unsubstituted alkylene group; or a substituted or unsubstituted aryl or heterocyclic ring or ring system linked to Z via a substituted or unsubstituted alkylene group either directly or via a group selected from $NR_1CO$—, $NR_1CONR_2$—, $OCONR_1$— or $NR_1COO$—, wherein $R_1$ and $R_2$ are independently selected from a hydrogen atom or a substituted or unsubstituted alkyl group;

each Z is independently selected from an unsubstituted or substituted group, ring or ring system attached via a heteroatom selected from sulfur, nitrogen, oxygen or phosphorus;

each L is independently a divalent, trivalent or tetravalent linking group;

p and each n are independently 0 or 1 k is an integer from 0 to 8;

and m is an integer from 2 to 4 provided that when p is 0, n is 0 and m is 2;

when p is 1, n is 0 or 1 and m is 2, 3 or 4; and

T is a counterion or a salt forming acid, and characterized in that b) said photographic material is developed in a hydroquinone-free developer, comprising a main developing agent of the ascorbic acid or ascorbic acid salt type, and as auxiliary developing agent a mixture of 3-pyrazolidones of which at least one has the formula (II):

(II)

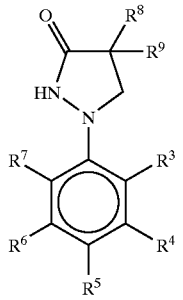

wherein $R^8$ and $R^9$ each independently represent hydrogen, a substituted or unsubstituted alkyl group, or a group represented by the formula:

$$(CH_2)_x—(L_1)_{n1}—A—(Sol)$$

wherein x is between 0 and 5 and $n_1$ is 0 or 1, $L_1$ represents a divalent group selected from

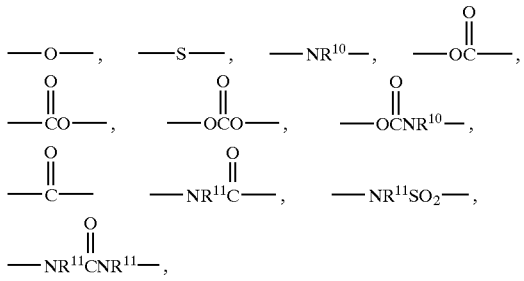

wherein $R^{10}$=$R^{11}$ or A—(Sol), $R^{11}$=H, alkyl or aryl;

A represents a divalent group selected from

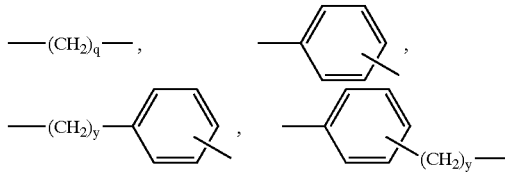

wherein q is between 0 and 5, and y is between 1 and 3;

(Sol) is a solubilizing group selected from:

$CO_2H$, $SO_3H$ or a salt, $SO_3K$, $NHSO_2R^{12}$, $SO_2NH_2$, $SO_2NHR^{12}$, polyhydroxyalkyl,

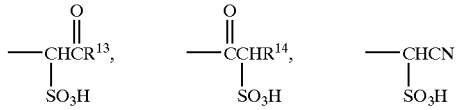

wherein $R^{12}$ is alkyl or aryl, $R^{13}$ is OH, alkyl or aryl and $R^{14}$ is hydrogen, alkyl or aryl;

$R^3$ to $R^7$ in formula (II) each independently represent hydrogen, an alkyl group, a substituted or unsubstituted alkoxy group, a substituted or unsubstituted aryloxy group, or a group represented by the formula:

$$(X_1)_z—(CH_2)_x—(L_1)_{n1}—A—(Sol)$$

wherein z=0 or 1;

$X_1$ represents a divalent group selected from

—O—, —S—, —$NR^{10}$— x, $L_1$, $n_1$, A, (Sol) and $R^{10}$ are as defined above, with the further proviso that at least one of the radicals $R^3$ to $R^9$ must contain a (Sol) group.

2. The method according to claim 1, wherein the hydrazide nucleating agent of formula (I) is in the emulsion layer and/or in the hydrophilic colloid layer.

3. The method according to claim 1, wherein each Y is independently an unsubstituted phenyl group or a phenyl group substituted with an alkylthio, alkylsulfonamido, alkyl, alkoxy or trifluoromethyl group.

4. The method according to claim 1, wherein when X is S═O, L' is a substituted or unsubstituted phenyl ring linked to Z via a methylene group, either directly or via a NHCO group.

5. The method according to claim 1, wherein when X is C, L' is a substituted or unsubstituted alkylene group.

6. The method according to claim 1, wherein each Z forms independently a substituted or unsubstituted pyridyl group.

7. The method according to claim 1, wherein the linking group L is a substituted or unsubstituted aromatic, alkylene, polyalkylene or polyalkylene oxide group, or a substituted or unsubstituted alkylene or polyalkylene group separated by one or more heteroatoms selected from nitrogen, oxygen and sulfur, wherein the groups within L may also be separated from each others by one or more substituted or unsubstituted alkylene, polyalkylene, aryl or heterocyclic groups, and L may include, linked to each carbonyl group, a terminal oxygen atom or a group NR', wherein R' is a hydrogen atom or a substituted or unsubstituted alkyl group.

8. The method according to claim 7, wherein the linking group L is selected from —$NH(CH_2)_2NH$—, —$NH(CH_2)_6NH$—, —$(CF_2)_2$, —$(CF_2)_3$, $NH(CH_2)_2O(CH_2)_2O(CH_2)_2O(CH_2)_2NH$—, —$OC_6H_4C(CH_3)_2C_6H_4O$— and —$NH(CH_2)_n$-piperidino-$(CH_2)_nNH$—, where n is 0 to 4.

9. The method according to claim 1, wherein p and each n are and m is 2.

10. The method according to claim 1, wherein p is 1 and each n is 0 or 1 and m is 2, 3 or 4.

11. The method according to claim 1, wherein at least one of the 3-pyrazolidones of the auxiliary developing agent is 4-methyl-4-hydroxymethyl-1-phenyl-3-pyrazolidone.

12. The method according to claim 1, wherein at least one of the 3-pyrazolidones of the auxiliary developing agent of formula (II) is

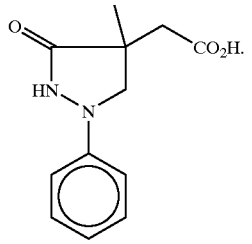

13. The method according to claim 1, wherein at least one of the 3-pyrazolidones of the auxiliary developing agent of formula (II) is

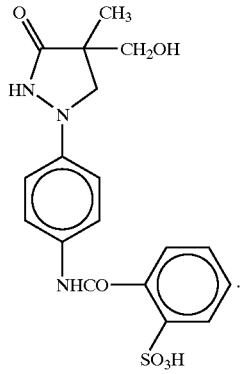

14. The method according to claim 1, wherein the nucleating agent of formula (I) is

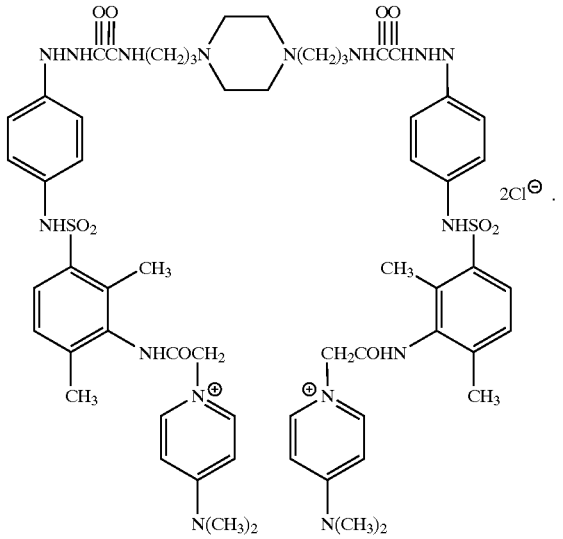

15. The method according to claim 1, wherein the nucleating agent of formula (I) is

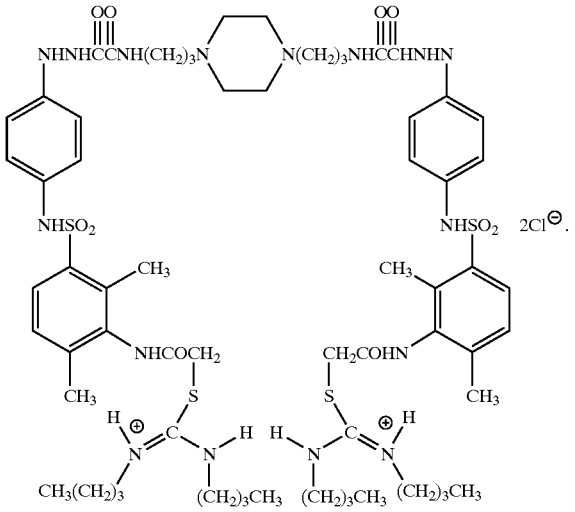

16. The method according to claim 1, wherein one of the 3-pyrazolidones of the auxiliary developing agent of formula (II) is

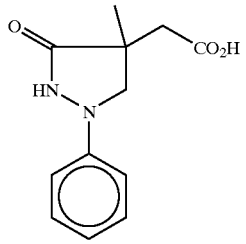

and the nucleating agent of formula (I) is

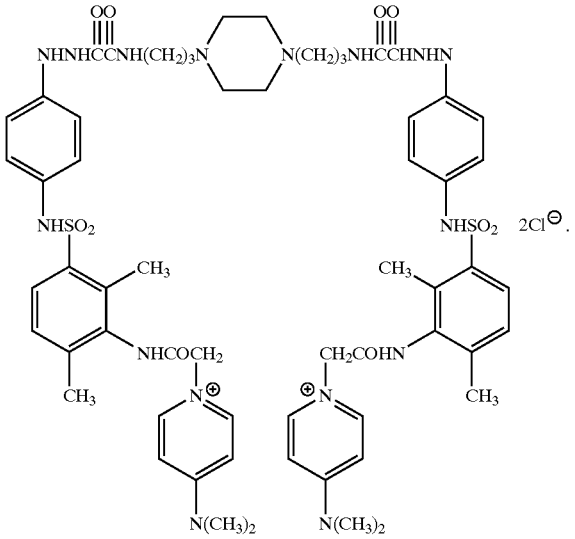

17. The method according to claim 1, wherein one of the 3-pyrazolidones of the auxiliary developing agent of formula (II) is

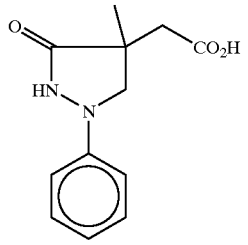

and the nucleating agent of formula (I) is

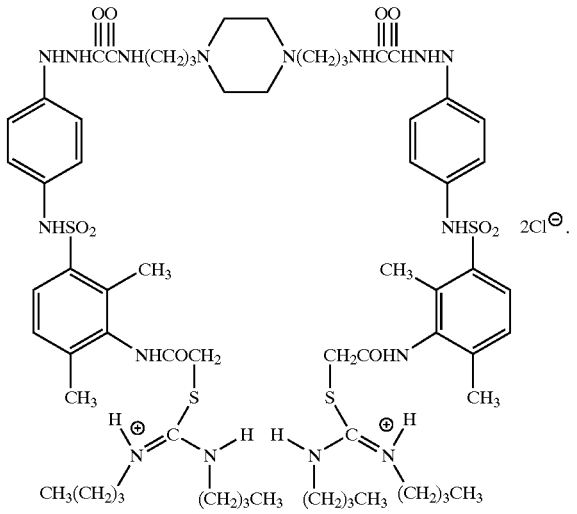

18. The method according to claim 1, wherein the developer comprises a development accelerator.

19. The method according to claim 18, wherein one of the 3-pyrazolidones of the auxiliary developing agent of formula (II) is

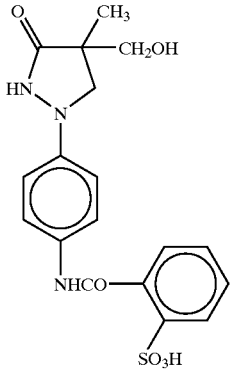

and the nucleating agent of formula (I) is

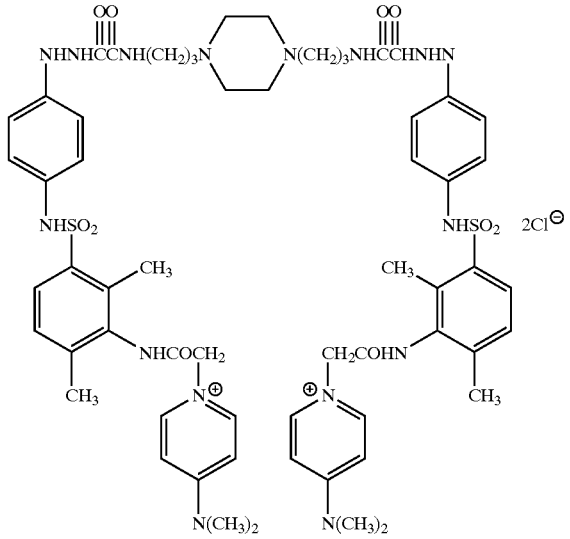

and the development accelerator is 1-phenethyl-2-picolinium bromide.

* * * * *